US010373426B2

(12) United States Patent
Robinson et al.

(10) Patent No.: US 10,373,426 B2
(45) Date of Patent: Aug. 6, 2019

(54) SYSTEM AND METHOD FOR PROVABLY FAIR GAMING

(71) Applicants: Joshua Robinson, Englewood, CO (US); Chris Guida, Denver, CO (US); Matt Dickson, Evergreen, CO (US)

(72) Inventors: Joshua Robinson, Englewood, CO (US); Chris Guida, Denver, CO (US); Matt Dickson, Evergreen, CO (US)

(73) Assignee: SPUR TRAIL INVESTMENTS, INC., Evergreen, CO (US)

( * ) Notice: Subject to any disclaimer, the term of this patent is extended or adjusted under 35 U.S.C. 154(b) by 0 days.

(21) Appl. No.: 15/274,347

(22) Filed: Sep. 23, 2016

(65) Prior Publication Data

US 2017/0084118 A1 Mar. 23, 2017

Related U.S. Application Data

(60) Provisional application No. 62/222,770, filed on Sep. 23, 2015.

(51) Int. Cl.
*G07F 17/32* (2006.01)

(52) U.S. Cl.
CPC ..... *G07F 17/3241* (2013.01); *G07F 17/3225* (2013.01)

(58) Field of Classification Search
CPC ..... G07F 17/3224; G07F 17/3241; G07F 17/1016; G07F 17/32
See application file for complete search history.

(56) References Cited

U.S. PATENT DOCUMENTS

2007/0238524 A1* 10/2007 Harris ..... A63F 13/75 463/42
2007/0238528 A1* 10/2007 Harris ..... A63F 13/12 463/42
2008/0171598 A1* 7/2008 Deng ..... G07F 17/32 463/40
2013/0059655 A1* 3/2013 Wasicek ..... A63F 13/08 463/29
2017/0266560 A1* 9/2017 Harris ..... A63F 13/45

* cited by examiner

*Primary Examiner* — Jay Trent Liddle
*Assistant Examiner* — Alex F. R. P. Rada, II
(74) *Attorney, Agent, or Firm* — Michael A. Kerr; Kerr IP Group, LLc

(57) ABSTRACT

Systems and methods for provably fair gaming for multiple player games are described. In various embodiments, a method for provably fair gaming comprises shuffling a virtual deck of cards, where the virtual deck comprises a plurality of virtual cards, and where each virtual card comprises a card value. The method further comprises salting each of the card values with a randomly selected first salt value, hashing each of the salted card values to form a first hashed deck, and broadcasting the first hashed deck to at least a first game player.

22 Claims, 18 Drawing Sheets

Player 1 Shuffle

- Game broadcasts Shoe's hashed deck to Player 1.
- Player 1 shuffles Shoe's hashed deck.
- Player 1 adds random salt to each card.
- Player 1 hashes the concatination of a salt and the initial value for each card saving the resulting hash, salt, and initial value in a lookup table..
- Player 1 sends hashed deck to Game.

250

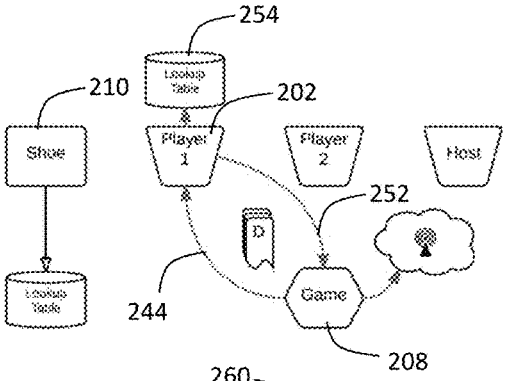

Player 2 Shuffle

- Game broadcasts Player 1's hashed deck to Player 2.
- Player 2 shuffles Shoe's hashed deck.
- Player 2 adds random salt to each card.
- Player 2 hashes the concatination of a salt and the initial value for each card saving the resulting hash, salt, and initial value in a lookup table..
- Player 2 sends hashed deck to Game. The Game then broadcasts the change.

256

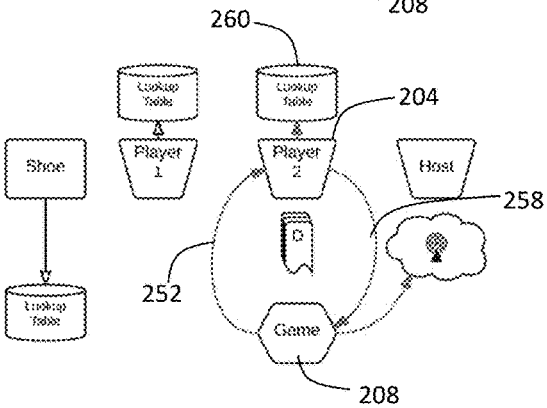

Host Shuffle

- Game broadcasts Player 2's hashed deck to Host.
- Host shuffles Shoe's hashed deck.
- Host adds random salt to each card.
- Host hashes the concatination of a salt and the initial value for each card saving the resulting hash, salt, and initial value in a lookup table.
- Host sends deck to Game. This deck is now called the commited deck. The Game then broadcasts the committed deck to all players.

268

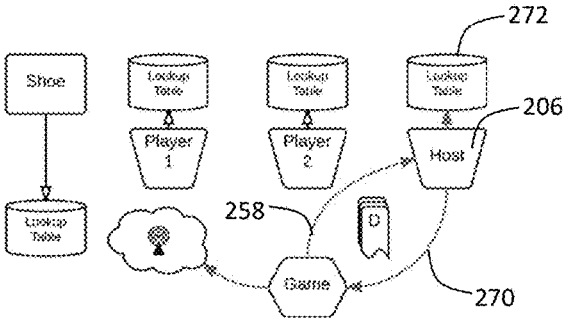

Figure 2C

Host Reveal

- Host draws next hashed card from commited deck.

- Host uses hashed card to lookup salt and it's initial value from lookup table.

- Host reveals initial value and salt for the card to the Game along with the public key of the player the card is being dealt to.

- Game broadcasts Host's revealed initial value and salt to all players.

275

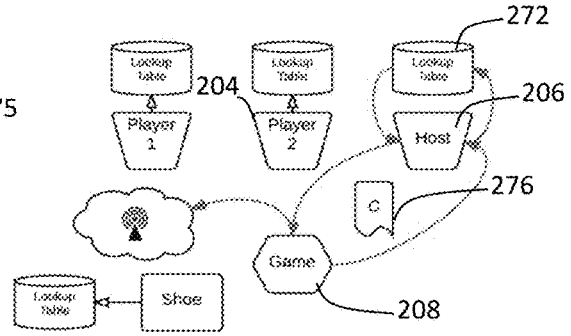

Player 2 Reveal

- Player 2 receives Player 3's revealed initial card value and salt.

- Player 2 uses Player 3's initial card value to lookup salt and it's initial value from lookup table.

- Player 2 reveals initial value and salt for the card to the Game.

- Game broadcasts Player 2's revealed initial value and salt to all players.

278

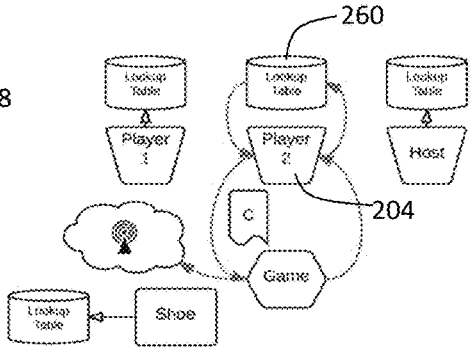

Player 1 Reveal

- Player 1 receives Player 2's revealed initial card value and salt.

- Player 1 uses Player 2's initial card value to lookup the salt and it's initial value from lookup table.

- Player 1 reveals initial value and salt for the card to the Game.

- Game broadcasts Player 1's revealed initial value and salt to all players.

282

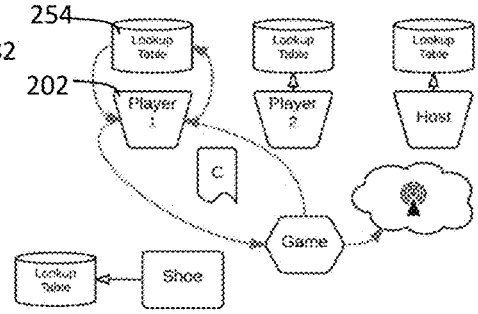

Shoe Reveal

- The Shoe receives Player 1's revealed initial card value and salt.

- Shoe uses Player 1's initial card value to lookup the salt and the cards face value from lookup table.

- Shoe uses public key of player that the Host recorded in the Game to encrypt the salt and cards face value.

- Shoe reveals encrypted card value and salt for the card to the Game.

- Game broadcasts Shoe's encrypted card face value and salt to the player the card is being dealt to.

- If Player the card was dealt to chooses to reveal the card they may broadcast the decrypted salt and face value to the game.

290

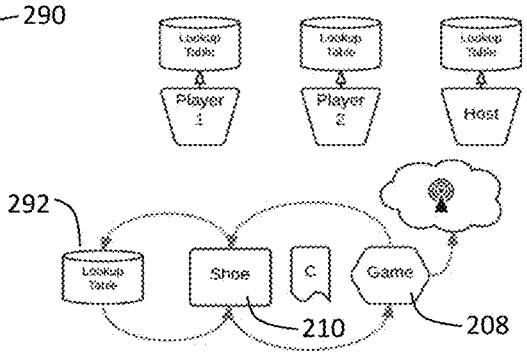

Figure 2D

SYSTEM AND METHOD FOR PROVABLY FAIR GAMING

CROSS-REFERENCE

This patent application claims the benefit of Provisional Patent Application 62/222,770 entitled, "Provably Fair Gaming for Multiple Player Games" filed on Sep. 23, 2015, which is hereby incorporated by reference.

FIELD

The present invention relates to a provably fair gaming system and method. More specifically, the provably fair gaming system and method allows for one or parties in a game of chance, game of skill, or any combination thereof to prove the game being played is a fair game event.

BACKGROUND

Provably fair gaming refers to fair game play, in which a virtual casino operator is not able to change the results of an on-line game. A provably fair game is a game that uses cryptographic algorithms to ensure their players that the game host or other players did not tamper with the outcome of the game after it has begun. Provably fair websites enable players to feel confident that outcomes from online games of chance are based on luck and mathematical probability.

Virtual casino operators rely on cryptography to provide provably fair gaming. For example, a player's game input is converted into digital data, which is then transformed into hash sequences, or strings, using cryptographic algorithms. The hash strings include a series of alphanumeric symbols that are intended to be impossible to decrypt. Additionally, there are no third parties (even dealers) having access to game outcomes in provably fair casinos.

Provably fair gaming technologies are generally associated with Bitcoin casinos, which allow the public to see outcomes that are based on the player's input and a secret that is disclosed and changes. For example, BitLotto uses a "blockchain" for provably fair gaming.

The blockchain solves the double spending problem associated with digital currencies. Simply put, a blockchain is a ledger of all transactions that is owned and monitored by everyone, but controlled by none. The blockchain is like a spreadsheet everyone has access to and updates to confirm each digital credit is unique. The benefit of the blockchain is that online wagers can be verified by anyone at any time after the results are published. The published results are used to prove that the game played was fair.

However, there are certain limitations to the provably fair gaming bitcoin gaming casinos that include the need for a casino operator to manage and control game play. Therefore, it would be beneficial to provide for a provably fair gaming system and method, in which gamblers can play provably fair games with other players, without the need for a house, e.g. a virtual casino operator.

Additionally, it would be beneficial to provide a provably fair crytptographic solution that can be integrated with virtual gambling websites.

Furthermore, there is a need for system and method that enables each player to validate that random game events occurred without tampering from a virtual casino or other player participating in the game.

SUMMARY

A provably fair gaming system and method is described. In a client-server embodiment, the provably fair gaming system and method includes a plurality of client computing devices communicating with a server module. More specifically, the provably fair gaming system and method includes a game session associated with a gaming module disposed on the server module. The game session includes a plurality of game events. The game session also includes a plurality of gaming objects, e.g. player cards, that each have a value and a position relative to the other gaming objects. Additionally, the game objects are organized according to instructions associated with the gaming module, e.g. a poker gaming module.

By way of example and not of limitation, a first player client computing device and a last player client computing device participates in the game session. During the game session each of the game objects salted by the server module and each of the salted game objects hashed by the server module.

A starting hash value that is generated for each hashed and salted game object by the server module. The starting hash value is communicated to the first player client computing device by the server module.

A first player salt is generated by the first player client computing device for each starting hash value received by the first player client computing device. Additionally, a first player resulting hash value is generated by hashing the received starting hash value and the first player salt, wherein the first player resulting hash is salted and hashed by each player until a last player computing device generates a last player resulting hash value.

The server module then combines a final salt to the last player resulting hash value to generate a final hash. The final hashes are prepared to be communicated from the server module to the player client computing device according to the gaming module instructions.

In one illustrative embodiment, the first player resulting hash value and the last player resulting hash value are the same value, when the first player client computing device is the only player client computing device participating in the game session.

In another illustrative embodiment, the first player client computing device receives the starting hash value and generates a first player resulting hash value. The last player client computing device receives a penultimate player resulting hash value, generates a last player random salt, and combines the last player random salt and the penultimate player resulting hash value. The last player client computing device also generates the last player resulting hash value by hashing the combination of the last player random salt ant the penultimate player resulting hash value.

In yet another illustrative embodiment, the provably fair gaming system includes a second player client computing device that receives a first player resulting hash value generated by the first player computing device. The second player client device generates a second player random salt and then generates a second resulting hash value by hashing the combination of the second player random salt with the first player resulting hash value.

In a still further illustrative embodiment, the gaming objects include a plurality of playing cards and the gaming module is a poker gaming module. Also, the gaming system includes a dealer module associated with a first server module, in which the dealer module corresponds to a poker dealer that initiates a game session. A plurality of player client computing devices join a poker game session and each of the player client computing devices exchange public keys. The dealer module requests a deck of playing cards from a shoe module that is associated with a second server module. The shoe module salts each playing card and the shoe module generates the starting hash value for each playing card and communicates the starting hash value to the player client computing device.

An off-line verification embodiment is described which includes each computing device receiving the position for at least one game object. Additionally, each computing device receives a list of salts used to generate the randomly organized final hashes; and each computing device receives the final hashes associated with the gaming objects. The computing device is then placed in an off-line mode and then proceeds to salt and hash a selected game object to generate an off-line final hash. The computing device then compares the off-line final hash with the received final hash to determine that the position of the gaming object was presented according to the game rules.

A provably fair gaming system and method may also be embodied in a peer-to-peer system architecture that includes a plurality of computing devices. More specifically, the provably fair gaming system and method includes a game session associated with a gaming module. The game session includes a plurality of game events and a plurality of gaming objects that each have a value and a position relative to the other gaming objects and wherein the plurality of game objects are organized according to instructions associated with the gaming module. The plurality of player computing devices include a host computing device and a last player computing device that participates in the game session.

During a game session, each of the game objects is salted by the host computing device and each of the salted game objects is hashed by the host computing device. A starting hash value that is generated for each hashed and salted game object by the host computing device.

The starting hash value is then combined with a first player salt generated by a first player computing device for each starting hash value received by the first player computing device. A first player resulting hash value is then generated by hashing the received starting hash value and the first player salt, wherein the first player resulting hash is salted and hashed by each player until the last player computing device generates a last player resulting hash value.

The host computing device then proceeds to combine a final salt to the last player resulting hash value to generate a final hash. A plurality of the final hashes are prepared to be communicated from the host computing device to the player client computing device according to the gaming module instructions.

In one illustrative embodiment, the first player resulting hash value and the last player resulting hash value are the same value, when the first player computing device is participating in the game session with the host computing device.

In another illustrative embodiment, a last player computing device receives a penultimate player resulting hash value and generates a last player random salt. The last player computing device hashes the combination of the last player random salt and the penultimate player resulting hash value to generate the last player resulting hash value.

In another illustrative embodiment, a second player computing device receives a first player resulting hash value generated by the first player computing device. The second player device then generates a second player random salt. Also, the second player device generates a second resulting hash value by hashing the combination of the second player random salt with the first player resulting hash value.

In a still further embodiment, the gaming objects include a plurality of playing cards and the gaming module is a poker gaming module. Additionally, the gaming system and method include a shoe module that salts each playing card. Furthermore, the shoe module generates the starting hash value for each playing card and communicates the starting hash value to the player computing device.

An off-line verification embodiment is described for the peer-to-peer embodiment that includes each computing device receiving the position for at least one game object. Additionally, each computing device receives a list of salts used to generate the randomly organized final hashes; and each computing device receives the final hashes associated with the gaming objects. The computing device is then placed in an off-line mode and then proceeds to salt and hash a selected game object to generate an off-line final hash. The computing device then compares the off-line final hash with the received final hash to determine that the position of the gaming object was presented according to the game rules.

FIGURES

The present invention will be more fully understood by reference to the following drawings which are presented for illustrative, not limiting, purposes.

FIG. 1A shows a provably fair gaming system that operates on a client-server architecture.

FIG. 1B there shows the initial steps performed during an illustrative provably fair game session that corresponds to the client/server architecture.

FIG. 2C shows the system and method for generating an illustrative "committed deck" with a Peer-to-Peer system architecture.

FIG. 2D shows an illustrative process for revealing the face value for the final hashes in the committed deck for the illustrative peer-to-peer gaming embodiment.

DESCRIPTION

Figure 1A:
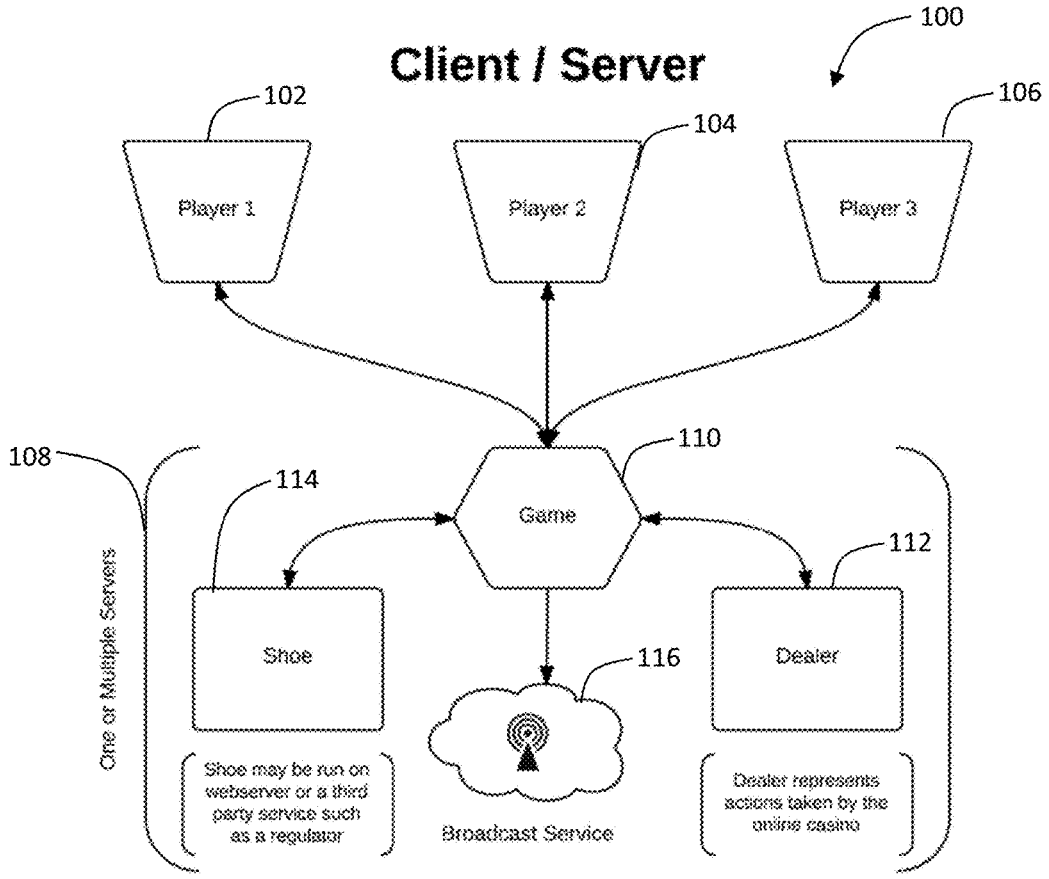
FIG. 1C shows the system and method for generating an illustrative "committed deck."
FIG. 1D shows an illustrative process for revealing the face value for the final hashes in the committed deck for the illustrative poker game session.

Persons of ordinary skill in the art will realize that the following description is illustrative and not in any way limiting. Other embodiments of the claimed subject matter will readily suggest themselves to such skilled persons having the benefit of this disclosure. It shall be appreciated by those of ordinary skill in the art that the transactional system and method described herein may vary as to configuration and as to details. The following detailed description of the illustrative embodiments includes reference to the accompanying drawings, which form a part of this application. The drawings show, by way of illustration, specific embodiments in which the invention may be practiced. It is to be understood that other embodiments may be utilized and structural changes may be made without departing from the scope of the claims.

The provably fair gaming systems and methods presented herein allow parties involved to prove that the games of chance are provably fair. The systems and methods may be applied to card games, dice games, bingo balls, lotteries, slot machines, roulette wheels or any entropy set. In general, the provably fair gaming system and method uses a commit and reveal strategy that is based on cryptographic hashes and is combined with multiple sources of entropy to prove fairness.

More specifically, the provably fair systems and methods makes games of chance fair by combining entropy with a commit/reveal scheme that inputs the entropy into a hash function and then reveals the randomized elements to the other player. The process of generating entropy refers to random number generation such as shuffling a deck of cards. The commit/reveal process is a two-step process, in which the "commit" step inputs entropy into a hash function and then shares the resulting hash with players before accepting wagers. The "reveal" step occurs during game play and refers to the process of revealing randomized items to the players. Another "reveal" step may occur at the end of the game session, i.e. the conclusion of the game, where the player can verify that the entropy was not modified during the game session. The game session also includes a plurality of gaming objects, e.g. player cards, that each has a value and a position relative to the other gaming objects. Additionally, the game objects are organized according to instructions associated with the gaming module, e.g. a poker gaming module Cryptographic hashing functions are deterministic one-way operations that take an input of any size and output a fixed-size hash. Hash functions are "deterministic" meaning that when you input the same value multiple times the hash function always returns the exact same hash, even though the resulting hash appears to be random. Also, hash functions are "one-way" because it is practically impossible to determine the original input even if you have access to the hash.

A cryptographic hash function is a hash function that is considered practically impossible to invert; that is, to recreate the input data from its hash value alone. Most cryptographic hash functions are designed to take a string of any length as input and produce a fixed-length hash value. Hash functions may be based on block ciphers.

Additionally, the provably fair gaming systems and methods take the entropy sets and build a merkle tree that allows verification of the order of the deck. A merkle tree is a tree of hashes based on a set of items such that a change to any item or their sequence changes each parent hash and the root hash. In order to prevent an attacker from determining the sequence, a salt (a random number that is mixed with known values) is to be mixed in with each item and revealed when the item is revealed.

The provably fair system and methods presented herein are directed to a client-server embodiment, a peer-to-peer embodiment and any combination thereof. An illustrative client server embodiment is presented in FIGS. 1A through 1D. Additionally, an illustrative peer-to-per embodiment is presented in FIGS. 2A-2D. Each of the provably fair embodiments includes a verification process that operates in off-line mode is also described, which is described in further detail in FIG. 3.

Referring to FIG. 1A there is shown a provably fair gaming system that operates on a client-server architecture 100. The illustrative clients 102, 104 and 106 are communicatively coupled to one or more servers 108 that run illustrative provably fair gaming modules. By way of example and not of limitation, the provably fair gaming modules include a game module 110, a dealer module 112 and a shoe module 114. Note, that the operations performed by the game module 110, the dealer module 112 and the shoe module are server modules which operates on one or more servers 108. By way of example and not of limitation, a publish/subscribe messaging pattern 116 may be utilized for broadcasting communications between the various provably fair gaming modules.

Figure 1B:
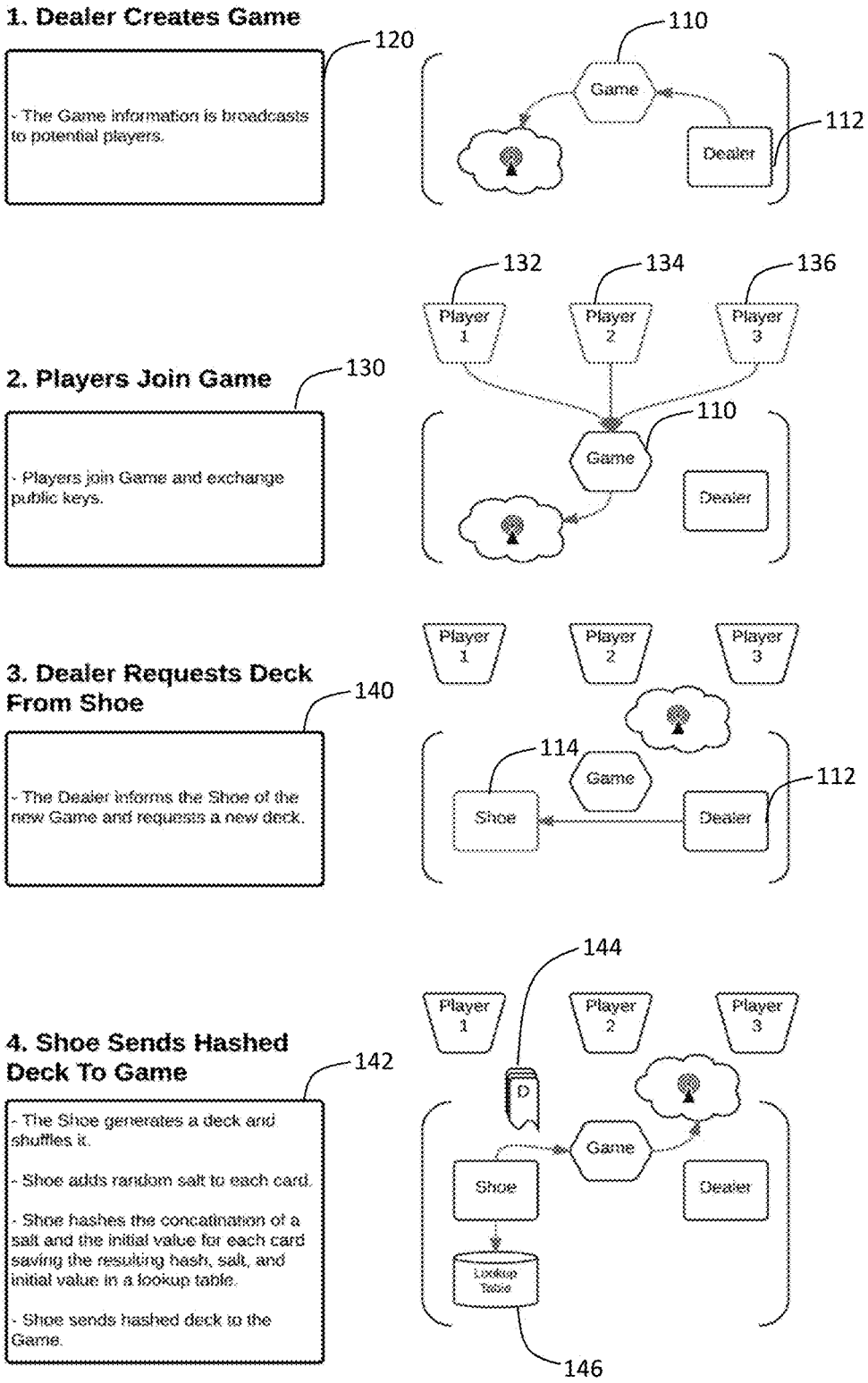
Figure 1C:
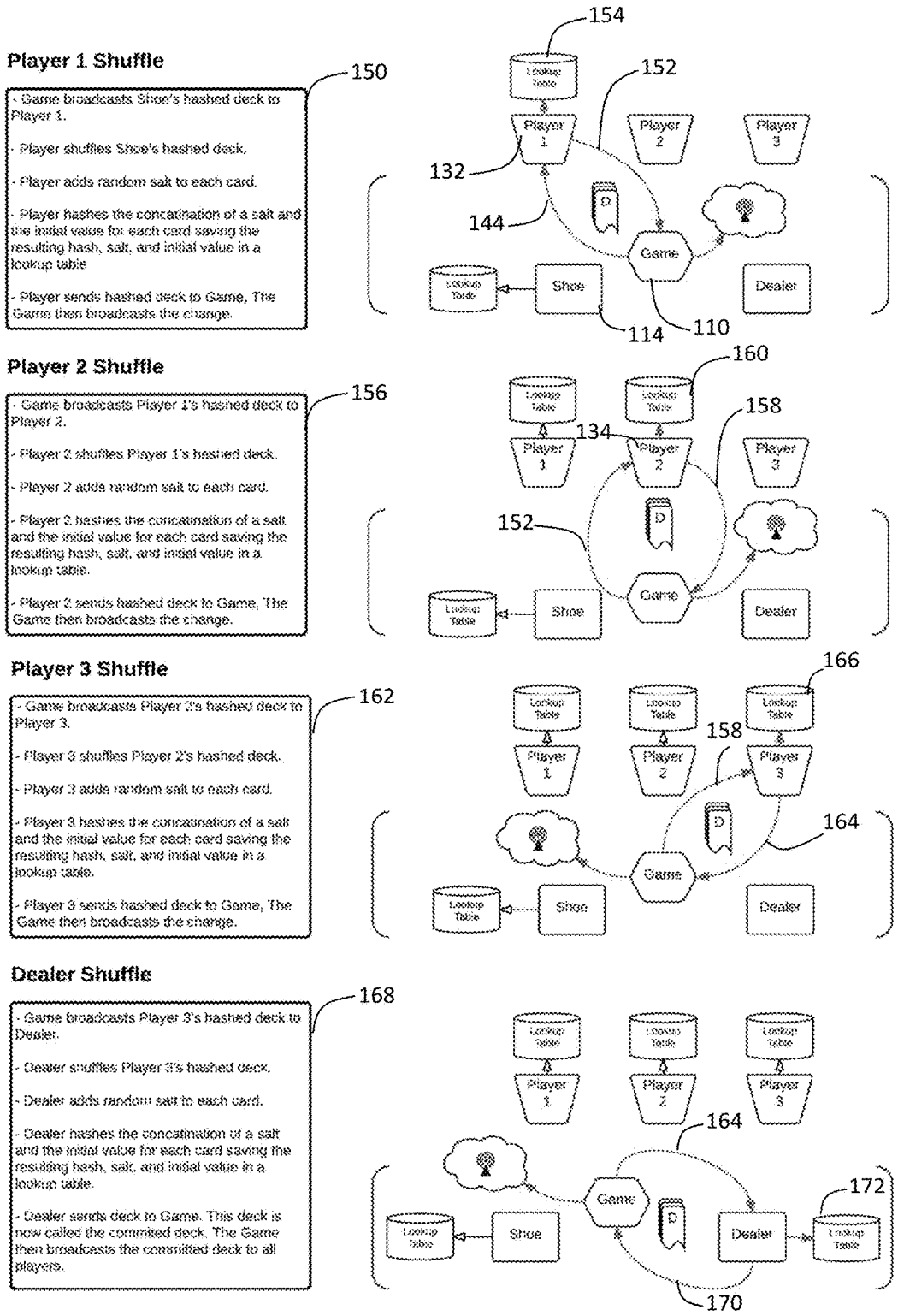

Referring to FIG. 1B there is shown the initial steps performed during an illustrative provably fair game session that corresponds to the client/server architecture 100. The illustrative provably fair game session begins at block 120 when a dealer module 112 creates or engages a game module 110 using an illustrative publish-subscribe broadcast service, in which the game module 110 broadcasts game information to potential players interfacing with a client device.

At block 130, an illustrative Player 1 computing device 132, an illustrative Player 2 computing device 134 and an illustrative Player 3 computing device 136 join the game session and communicate with game module 110 using an illustrative publish and subscribe broadcast service 116. When the players join the game session, the players also exchange their public keys.

At block 140, the dealer module 112 informs the shoe module 114 about the new game session and requests a deck of cards.

At block 142, the shoe module 114 then proceeds to generate deck 144 and shuffle deck 144 in a random manner. The shoe module 114 then proceeds to add a random salt to each card in the shuffled deck. The illustrative shoe module 114 then generates a starting hash value by hashing the random salt, which is combined with an initial value associated with the illustrative shuffled card. In the illustrative embodiment, the shoe module random salt is concatenated with the shuffled card value to generate the starting hash value. In other words, the initial value associated with the randomly shuffled card is concatenated with the dealer generated random salt—and the resulting concatenation is then run through a hashing function, which produces a starting hash value.

This process of hashing the concatenation of the unique random salt and the corresponding shuffled card is repeated for each card in the deck; and the plurality of starting hash values results in a "hashed deck" generated by the shoe module 114. The hashed deck then is sent from the shoe module 114 to the game module 110. The hashed deck is then converted to a "committed deck" using the illustrative systems and methods presented in FIG. 1C Referring now to FIG. 1C, there is shown the system and method for generating an illustrative "committed deck." By way of example and not of limitation, the committed deck is a deck of cards that is salted and hashed by each player and the dealer; thus, a committed deck includes a plurality of salted and hashed card values from each player computing device, the dealer module and the shoe module. More generally, the committed deck is a plurality of final hashes generated by one or more server modules and these final hashes are then managed and controlled by the gaming module 110.

By way of example and not of limitation, the method for generating the "committed deck" is shown in blocks 150, 156, 162 and 168. By way of example and not of limitation, the committed deck is associated with an illustrative poker game. In general, each player computing device and the dealer module 112 perform the illustrative steps of shuffling, salting and hashing each card in the hashed deck (generated by the shoe module 114). Thus, each player computing device and the dealer module adds their own "entropy" to the shuffling process. The addition of entropy to the shuffling or randomizing of a plurality of gaming objects is one of the process steps for making the client-server game session provably fair. An illustrative off-line process for determining that the game session is provably fair is provided in FIG. 3 below.

Returning to FIG. 1C, the illustrative process step 150 includes having the game module 110 broadcast the hashed deck (which includes a plurality of starting hash values) generated by shoe module 114 to the Player 1 client computing device 132. The Player 1 client computing device 132 then proceeds to shuffle the starting hash values associated with the hashed deck 144 generated by the shoe module 114. Additionally, the Player 1 computing device 132 proceeds to add random salt to each starting hash value. The Player 1 computing device 132 also hashes the concatenation of the salt and the received starting hash value for each card to generate a Player 1 resulting hash value 152. The Player 1 resulting hash, salt and the received shoe hash are stored in a look-up table 154. The Player 1 computing device then transmits the Player 1 hashed deck to the game module 110, which then broadcasts the Player 1 hashed deck according to the game rules corresponding to the game module 110.

Continuing to illustrative process step 156, the game module 110 broadcasts the Player 1 hashed deck generated by the Player 1 client computing device 132 to the Player 2 client computing device 134. The Player 2 client computing device 134 then proceeds to shuffle the hashed deck 152 generated by the Player 1 client computing device. Additionally, the Player 2 computing device 134 proceeds to add random salt to each Player 1 resulting hash value. The Player 2 computing device 134 hashes the concatenation of the salt and the Player 1 resulting hash value to generate a Player 2 resulting hash 158. The Player 2 resulting hash value 158, salt and the received Player 1 resulting hash 152 are stored in a look-up table 160. The Player 2 resulting hashes are then combined to generate a Player 2 hashed deck. The Player 2 computing device then transmits the Player 2 hashed deck to the game module 110, which then broadcasts the Player 2 hashed deck according to the game rules corresponding to the game module 110.

The process then continues to illustrative block 162, where the game module 110 broadcasts the Player 2 hashed deck generated by the Player 2 client computing device 134 to the Player 3 client computing device 136. The Player 3 client computing device 136 then proceeds to shuffle the hashed deck 158 generated by the Player 2 client computing device. Additionally, the Player 3 computing device 136 proceeds to add random salt to each Player 2 resulting hash value 158. The Player 3 computing device 136 hashes the concatenation of the salt and the initial value for each card to generate a Player 3 resulting hash 164. The Player 3 resulting hash 164, salt and the Player 2 resulting hash 158 are stored in a look-up table 166. The Player 3 resulting hashes are combined to generate a Player 3 hashed deck. The Player 3 computing device then transmits the Player 3 hashed deck to the game module 110, which then broadcasts the Player 3 hashed deck according to the game rules corresponding to the game module 110.

The illustrative method proceeds to block 168 where the dealer module 112 receives the Player 3 hashed deck. The dealer module 112 (operating on a server) then proceeds to shuffle the hashed deck 164 generated by the Player 3 client computing device. Additionally, the dealer module 112 proceeds to add random salt to each Player 3 resulting hash value. The dealer module 112 hashes the concatenation of the salt and the Player 3 resulting hash value for each card to generate a Dealer resulting hash 170. The Dealer resulting hash 170, salt and the Player 3 resulting hashes 164 are stored in a look-up table 172. The Dealer resulting hash values are then combined to generate a Dealer hashed deck. The illustrative Dealer server appliance then transmits the Dealer hashed deck to the game module 110, which now has a "committed deck," which is a deck of cards that is salted and hashed by each player and the dealer.

Figure 1D:
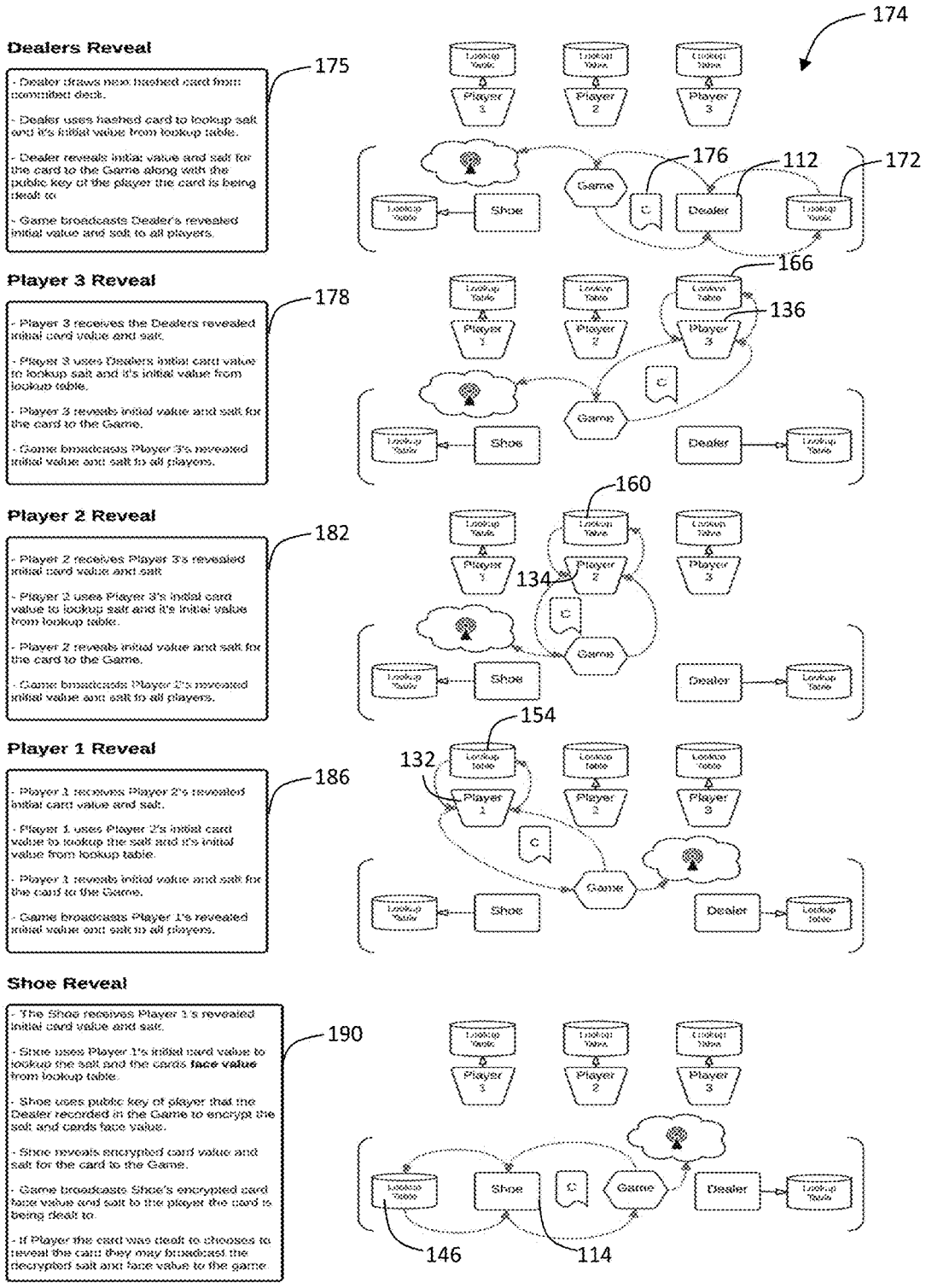

Referring now to FIG. 1D, there is shown an illustrative process 174 for revealing the face value for the final hashes in the committed deck for the illustrative poker game session. The illustrative process for revealing the face card from a card in the committed deck is initiated at dealer reveal block 175.

At block 175, the dealer reveal step includes having the dealer module 112 draw the final hash value from the committed deck 176. The dealer module 112 then uses the final hash value to lookup the associated salt from the look-up table 172. The dealer module 112 then proceeds to reveal the last player resulting hash value to the game module 110 along with the public key for the last player client computing device, which is also the Player 3 client computing device 136. The last player resulting hash, which is also referred as "the Player 3 resulting hash" in the illustrative embodiment, is generated by accessing the look-up table 172. The look-up table 172 includes the final hash value, the associated random salt (generated by the dealer module 112) and the last player resulting hash value, which is also referred as the Player 3 resulting hash value. Therefore, the final hash is first "unwound" by the dealer module 112 during the "reveal" step because the dealer module 112 generated the final hash value. The game module 110 then proceeds to broadcast the last player resulting hash value, i.e. the Player 3 resulting hash value, and the dealer's salt (generated by dealer module 112) to all player client computing devices. The method of revealing the face value of the illustrative card from a committed deck then proceeds to block 178.

At block 178, the illustrative Player 3 client computing device 136 receives the Player 3 resulting hash value. The Player 3 client computing device 136 then accesses the look-up table 166—and uses the Player 3 resulting hash value to reveal the Player 3 random salt, and the Player 2 resulting hash value. The Player 3 resulting hash value, the Player 3 random salt, and the Player 2 resulting hash value are revealed to game module 110. The game module 110 then proceeds to broadcast the Player 3 resulting hash value, the Player 3 random salt and the Player 2 resulting hash value to each player computing device.

At block 182, the illustrative Player 2 client computing device 134 receives the Player 2 resulting hash. The Player 2 client computing device 134 then accesses the look-up table 160—and uses the Player 2 resulting hash value to reveal the Player 2 random salt, and the Player 1 resulting hash value. The Player 2 resulting hash value, the Player 2 random salt, and the Player 1 resulting hash value are revealed to game module 110. The game module 110 then proceeds to broadcast the Player 2 resulting hash value, the Player 2 random salt and the Player 1 resulting hash value to each player computing device.

At block 186, the illustrative Player 1 client computing device 132 receives the Player 1 resulting hash. The Player 1 client computing device 132 then accesses the look-up table 154—and uses the Player 1 resulting hash value to reveal the Player 1 random salt, and the starting hash value. The Player 1 resulting hash value, the Player 1 random salt, and the starting hash value are revealed to game module 110. The game module 110 then proceeds to broadcast the Player 1 resulting hash value, the Player 1 random salt and the starting hash value to each player computing device.

At block 190, the shoe module 114 receives the starting hash value. The shoe module 114 then accesses the look-up table 146—and uses the starting hash value to reveal the shoe module's random salt, and the face value of the card. The shoe module 114 then uses the public key of the player that the dealer recorded in the game session to encrypt the shoe module's salt and cards face value; and then the shoe module 114 reveals encrypted card value and shoe module random salt to the game module 110.

The game module 110 then broadcasts the shoe module 114 encrypted card face value and shoe module random salt to the player that is being dealt the card. The player then decrypts the encrypted card face value with their private key—and the player also decrypts the shoe module random salt. If the player chooses to reveal the decrypted card, then the player broadcasts the decrypted salt and face value to the game module 110, which then reveals the face value of the card according to the game rules corresponding to the game session.

Figure 2A:
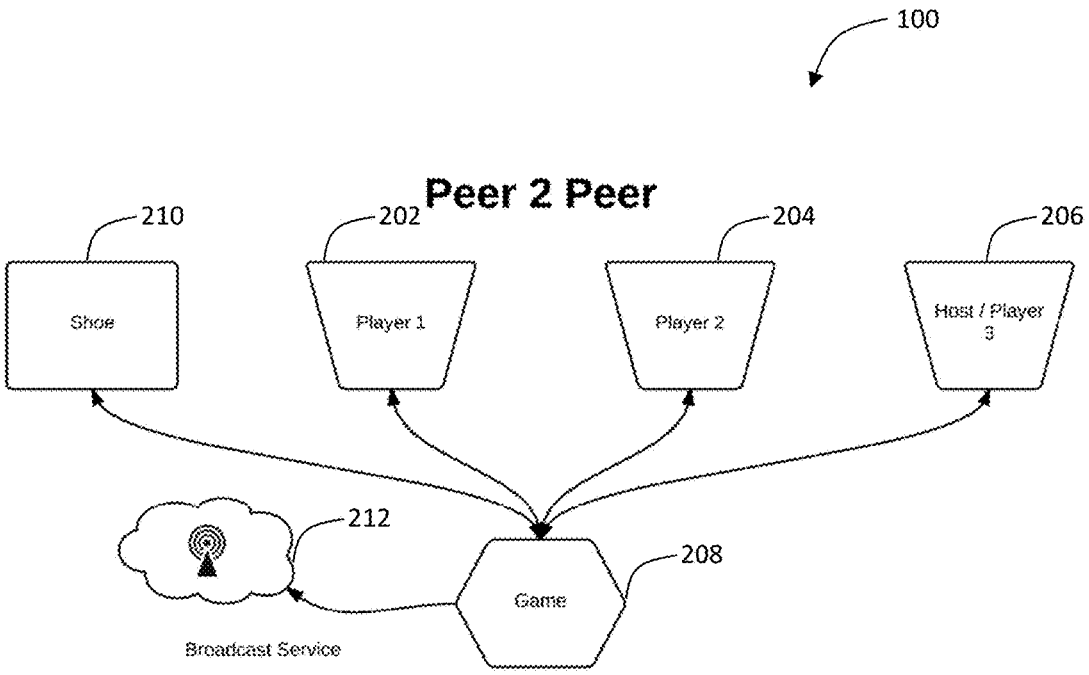
FIG. 2A shows a provably fair gaming system that operates on a peer-to-peer architecture.

Referring to FIG. 2A there is shown a provably fair gaming system that operates on a peer-to-peer architecture 200. The illustrative peers computing devices 202, 204 and 206 are communicatively coupled to one another. By way of example and not of limitation, the provably fair gaming modules include a game module 208, and a shoe module 110. By way of example and not of limitation, a publish/subscribe messaging pattern 212 may be utilized for broadcasting communications between the various provably fair gaming modules.

Figure 2B:
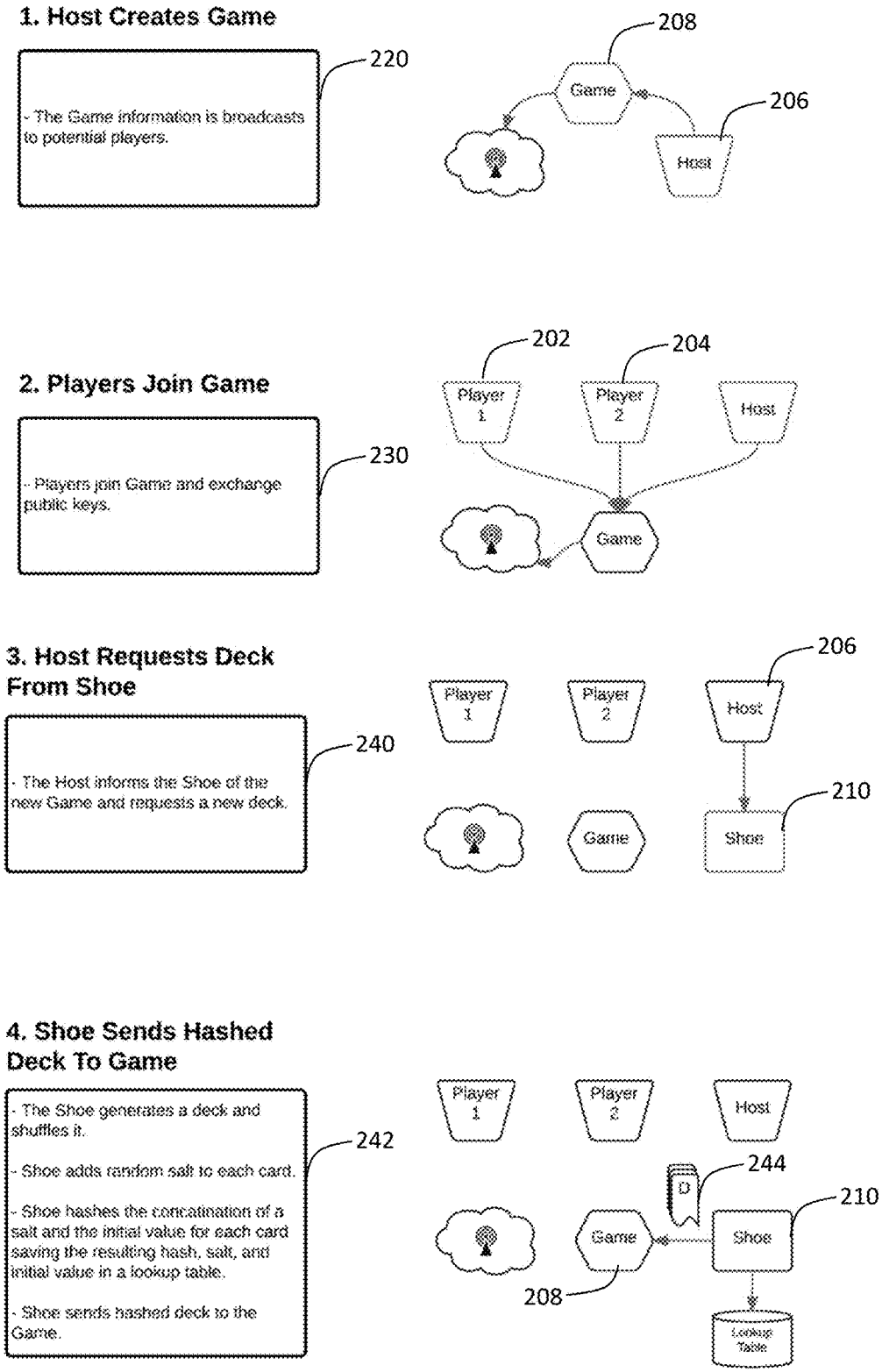
FIG. 2B shows the initial steps performed during an illustrative provably fair game session that corresponds to the peer-to-peer architecture.

Referring to FIG. 2B there is shown the initial steps performed during an illustrative provably fair game session that corresponds to the peer-to-peer architecture 200. At block 220, the illustrative provably fair game session begins when a host computing device 206 (which is also referred to as Player 3) creates or engages a game module 208 using an illustrative publish-subscribe broadcast service, in which the game module 208 broadcasts game information to players operating in a peer-to-peer system architecture.

At block 230, an illustrative Player 1 computing device 202 and an illustrative Player 2 computing device 204 join the game session by communicating with game module 110 using an illustrative publish and subscribe broadcast service 116. During the process of joining the game session, the player computing devices share their public keys.

At block 240, the host computing device 206 (Player 3) informs the shoe module 210 about the new game session and requests a deck of cards.

At block 242, the shoe module 210 then proceeds to generate deck 244 and shuffle deck 244 in a random manner. The shoe module 210 then proceeds to add a random salt to each card in the shuffled deck. The illustrative shoe module 210 then generates a starting hash value by hashing the random salt, which is combined with an initial value associated with the shuffled card. In the illustrative embodiment, the shoe module random salt is concatenated with the shuffled card value to generate the starting hash value. In other words, the initial value associated with the randomly shuffled card is concatenated with the dealer generated random salt—and the resulting concatenation is then run through a hashing function, which produces a starting hash value.

This process of hashing the concatenation of the unique random salt and the corresponding shuffled card is repeated for each card in the deck; and the resulting "hashed deck" generated by the shoe module 210 is sent to the game module 208. The hashed deck is then converted to a "committed deck" as described in FIG. 2C.

The operations described above, which are associated within the context of a peer-to-peer system architecture, include process steps 220, 230, 240 and 242 that are similar to the process steps 120, 130, 140 and 142, which are associated with the client-server system architecture.

Referring now to FIG. 2C, there is shown the system and method for generating an illustrative "committed deck" with a Peer-to-Peer system architecture. As described above, the committed deck is a deck of cards that is salted and hashed by each player computing device; thus, a committed deck includes a plurality of salted and hashed card values from each player-to-player or peer-to-peer computing device. More generally, the committed deck is a plurality of final hashes generated by contributions from each of the peer-to-peer to computing devices and these final hashes are then managed and controlled by the gaming module 208.

By way of example and not of limitation, the method for generating the "committed deck" with a peer-to-peer computing environment is shown in blocks 250, 256 and 268. By way of example and not of limitation, the committed deck is associated with an illustrative poker game as described above. In general, each player computing device performs the illustrative steps of shuffling, salting and hashing each card in the hashed deck (generated by the shoe module 210). Thus, each player computing device adds their own "entropy" to the shuffling process. The addition of entropy to the shuffling or randomizing of a plurality of gaming objects is one of the process steps for making the peer-to-peer game session provably fair. An illustrative off-line process for determining that the game session is provably fair is provided in FIG. 3 below.

Returning to FIG. 2C, the illustrative process step 250 includes having the game module 208 broadcast the hashed deck (which includes a plurality of starting hash values) generated by shoe module 210 to the Player 1 computing device 202. The Player 1 computing device 202 then proceeds to shuffle the starting hash values associated with the hashed deck 244 generated by the shoe module 210. Additionally, the Player 1 computing device 202 proceeds to add random salt to each starting hash value. The Player 1 computing device 202 also hashes the concatenation of the salt and the received starting hash value for each card to generate a Player 1 resulting hash value 252. The Player 1 resulting hash, salt and the received shoe hash are stored in a look-up table 254. The Player 1 computing device then transmits the Player 1 hashed deck to the game module 208, which then broadcasts the Player 1 hashed deck according to the game rules corresponding to the game module 208.

Continuing to illustrative process step 256, the game module 208 broadcasts the Player 1 hashed deck generated by the Player 1 computing device 202 to the Player 2 computing device 204. The Player 2 computing device 204 then proceeds to shuffle the hashed deck 252 generated by the Player 1 computing device. Additionally, the Player 2 computing device 204 proceeds to add random salt to each Player 1 resulting hash value. The Player 2 computing device 204 hashes the concatenation of the salt and the Player 1 resulting hash value to generate a Player 2 resulting hash 258. The Player 2 resulting hash value 258, salt and the received Player 1 resulting hash 252 are stored in a look-up table 260. The Player 2 resulting hashes are then combined to generate a Player 2 hashed deck. The Player 2 computing device then transmits the Player 2 hashed deck to the game module 208, which then broadcasts the Player 2 hashed deck according to the game rules corresponding to the game module 208.

The illustrative method proceeds to block 268 where the host computing device 206 receives the Player 2 hashed deck. Note, the host computing device is also illustrative Player 3 computing device. The host computing device 206 (operating as an individual peer) then proceeds to shuffle the hashed deck 258 generated by the Player 2 computing device. Additionally, the host computing device 206 proceeds to add random salt to each Player 2 resulting hash value. The host computing device 206 hashes the concatenation of the salt and the Player 2 resulting hash value for each card to generate a host resulting hash 270. The host resulting hash 270, salt and the Player 2 resulting hashes 258 are stored in a look-up table 272. The host resulting hash values are then combined to generate a host hashed deck. The illustrative host computing device then transmits the host hashed deck to the game module 110, which now has a "committed deck."

Referring now to FIG. 2D, there is shown an illustrative process 274 for revealing the face value for the final hashes in the committed deck for the illustrative peer-to-peer gaming embodiment. The illustrative process for revealing the face card from a card in the committed deck is initiated at host reveal block 275.

At block 275, the host computing device 206 (i.e. the Player 3 computing device) reveal step includes having the host computing device 206 draw the final hash value from the committed deck 276. The host computing device 206 then uses the final hash value to lookup the associated salt from the look-up table 272. The host computing device 206 then proceeds to reveal the last player resulting hash value to the game module 208 along with the public key for the last player computing device, which is also the Player 2 computing device 204. The last player resulting hash, which is also referred as "the Player 2 resulting hash" in the illustrative embodiment, is generated by accessing the look-up table 272. The look-up table 272 includes the final hash value, the associated random salt (generated by the host computing device 206) and the last player resulting hash value, which is also referred as the Player 2 resulting hash value.

Therefore, the final hash value is first "unwound" by the host computing device 206 during the "reveal" step because the host computing device 206 generated the final hash value. The game module 208 then proceeds to broadcast the last player resulting hash value, i.e. the Player 2 resulting hash value, and the host salt (generated by host computing device 206) to all player computing devices. The method of revealing the face value of the illustrative card from a committed deck then proceeds to block 278.

At block 278, the illustrative Player 2 computing device 204 receives the Player 2 resulting hash value. The Player 2 computing device 204 then accesses the look-up table 260—and uses the Player 2 resulting hash value to reveal the Player 2 random salt, and the Player 1 resulting hash value. The Player 2 resulting hash value, the Player 2 random salt, and the Player 1 resulting hash value are revealed to game module 208. The game module 208 then proceeds to broadcast the Player 2 resulting hash value, the Player 2 random salt and the Player 1 resulting hash value to each player computing device.

At block 282, the illustrative Player 1 computing device 202 receives the Player 1 resulting hash. The Player 1 computing device 202 then accesses the look-up table 254—and uses the Player 1 resulting hash value to reveal the Player 1 random salt, and the starting hash value. The Player 1 resulting hash value, the Player 1 random salt, and the starting hash value are revealed to game module 208. The game module 208 then proceeds to broadcast the Player 1 resulting hash value, the Player 1 random salt and the starting hash value to each player computing device.

At block 290, the shoe module 210 receives the starting hash value. The shoe module 210 then accesses the look-up table 292—and uses the starting hash value to reveal the shoe module's random salt, and the face value of the card. The shoe module 210 then uses the public key of the player that the host computing device recorded in the game session to encrypt the shoe module's salt and cards face value; and then the shoe module 210 reveals encrypted card value and shoe module random salt to the game module 208.

The game module 208 then broadcasts the shoe module 210 encrypted card face value and shoe module random salt to the player that is being dealt the card. The player then decrypts the encrypted card face value with their private key—and the player also decrypts the shoe module random salt. If the player chooses to reveal the decrypted card, then the player broadcasts the decrypted salt and face value to the game module 208, which then reveals the face value of the card according to the game rules corresponding to the game session.

Figure 3:
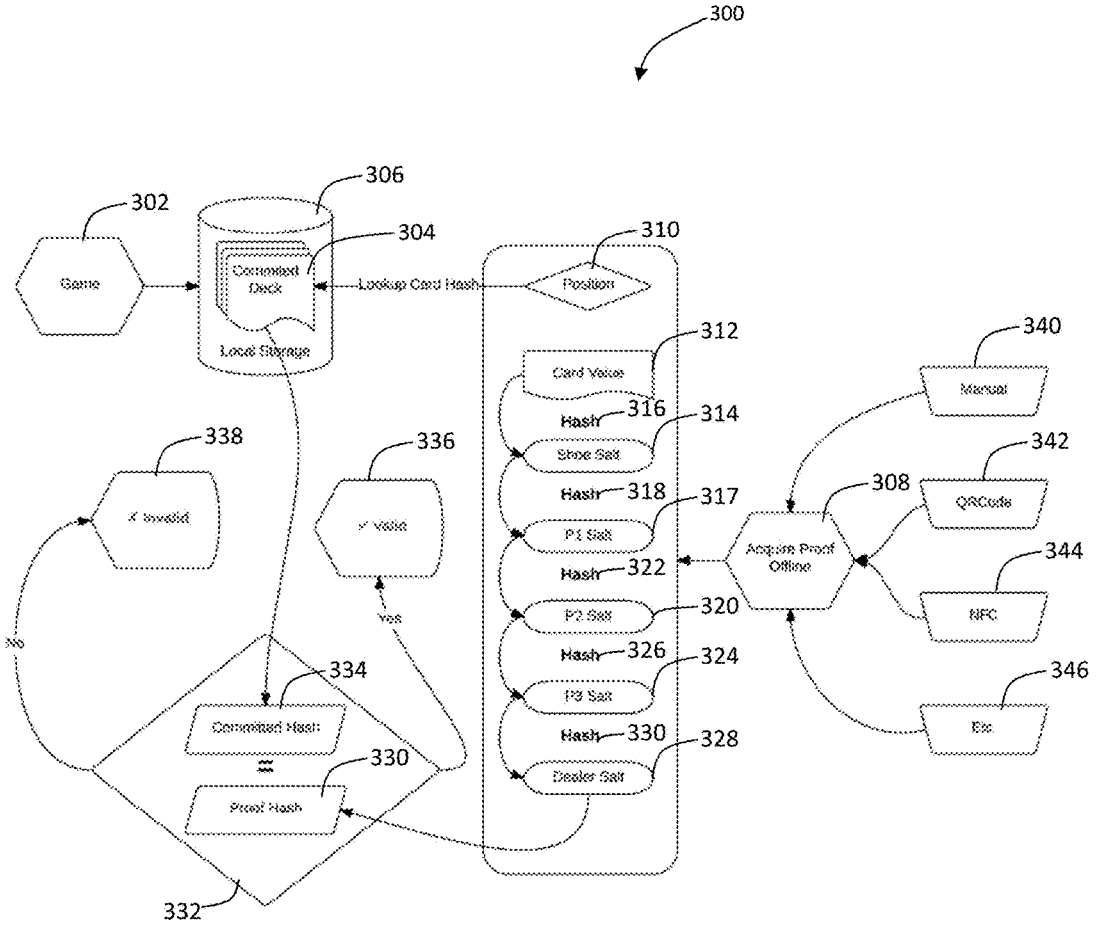
FIG. 3 shows an illustrative offline verification process that allows a player to verify that a face value card dealt from a committed deck was accurately dealt and fairly shuffled.

Referring to FIG. 3, there is shown an illustrative offline verification process 300 that allows a player to verify that a face value card dealt from a committed deck was accurately dealt and fairly shuffled. As described above, a committed deck has been shuffled, salted and hashed by each player. The committed deck is dealt during the illustrative poker game session.

In operation, an illustrative game module 302 receives a committed deck 304 that is communicated from the game module 302 to a local storage module 306 that is associated with a player computing device. The process of generating the committed deck and storing the committed deck locally on a player computing device is performed before initiating the offline verification process. The committed deck includes a plurality of final hash values, which may also be referred to as a "committed hash" or a plurality of "committed hashes."

To perform the offline verification process for a particular dealt card, the player initiates an acquire proof offline mode 308. The illustrative acquire proof offline mode 308 obtains a position 310 for the dealt card. In the illustrative embodiment, the acquire proof offline mode receives a plurality of offline gaming object data including a card value 312, a shoe salt 314, a starting hash value 316, a Player 1 salt 317, a Player 1 resulting hash 318, a Player 2 salt 320, a Player 2 resulting hash value 322, a Player 3 salt 324, a Player 3 hash 326, a dealer salt 328 and a final hash 330.

The offline gaming object data is communicated during the offline mode 308 via an illustrative manual operation code 340, an embedded QR code 342, an NFC code and any other such system, device or method 344 for communicating the off-line gaming object data. By way of the example and not of limitation, the manual operation code may be initiated by a player, whereas the embedded QR code or NFC code may be read automatically the illustrative player computing device.

The illustrative player computing device then has to enter an offline mode, which can be accomplished by closing the WiFi connection or placing a mobile device in "airplane mode."

After the illustrative player enters the offline mode, the offline gaming object data for a particular position is accessed by the player computing device. The player computing device then proceeds to generate a final proof hash using the illustrative card value 312, shoe salt 314, starting hash value 316, Player 1 salt 317, Player 1 resulting hash 318, Player 2 salt 320, Player 2 resulting hash value 322, Player 3 salt 324, Player 3 hash 326 and dealer salt 328. The resulting final proof hash 330 is then stored at decision diamond 332. The resulting proof hash 330 is generated using the illustrative client-server system, peer-to-peer system or any combination thereof.

Simultaneously or serially, the final hash value having the same position 310 is extracted from the committed deck 304; the final hash value corresponding to the position 210 is referred to as the "committed hash" value 334.

If there is a match between the resulting final proof hash value 330 and the committed hash value 334, then the card value and position have achieved a valid state 336 and the game is provably fair. However, if the resulting proof final hash 330 and the committed hash value 334 do NOT match, then the card value and position are NOT provably fair and the card value and position reach an invalid state 338.

Although the embodiment described above may be directed to an individual player verifying that the cards, number or symbols are provably delivered. The individual player may be replaced by a virtual casino property, a regulating agency, a regulator, or any other such party interested in ensuring the cards, numbers or symbols are dealt in a provably fair manner.

Figure 4:
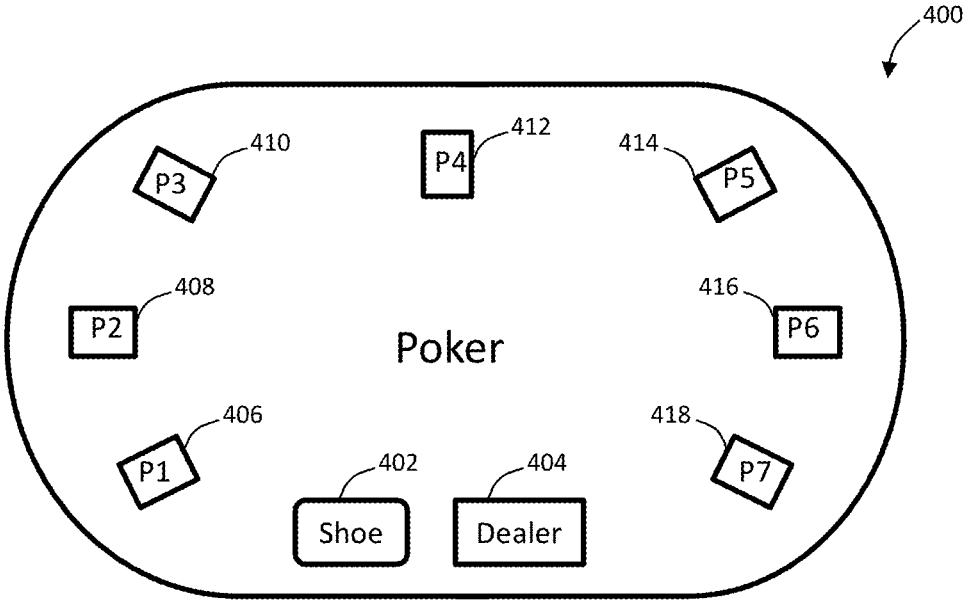
FIG. 4 shows an illustrative virtual poker table and the parties in the provably fair system and method.

Referring to FIG. 4 there is shown an illustrative virtual poker table 400 and the parties in the provably fair system and method. The illustrative virtual table 400 runs a card game that includes three elements, namely, a shoe module 402, a dealer module 404 and a plurality of player computing devices 406 through 418.

In the illustrative poker embodiment, the shoe module 402 may be controlled by the game operator, e.g. virtual casino, the dealer module 404, the player computing devices 406-418 or a third party. This shoe module performs a variety of functions that include shuffling the deck of cards and revealing the cards to the dealer module, when the dealer module asks for the cards. In the illustrative embodiment, the shoe module 402 utilizes a true random number generator for the initial shuffle.

In operation, the illustrative dealer module 404 is responsible for setting up a new game session with players 406-418. The dealer module 404 provides a service that is controlled by the game operator. As presented in further detail below, the game is initiated with an obscured first source of entropy, which is associated with the shoe module 402. A second source of entropy may come from an externally verifiable source picked by the dealer module, which is not controlled by any single player.

The player computing devices 406 through 418 each have access to the obfuscated shuffled deck generated by shoe module 402 and further obfuscated by the dealer module.

Figure 5:
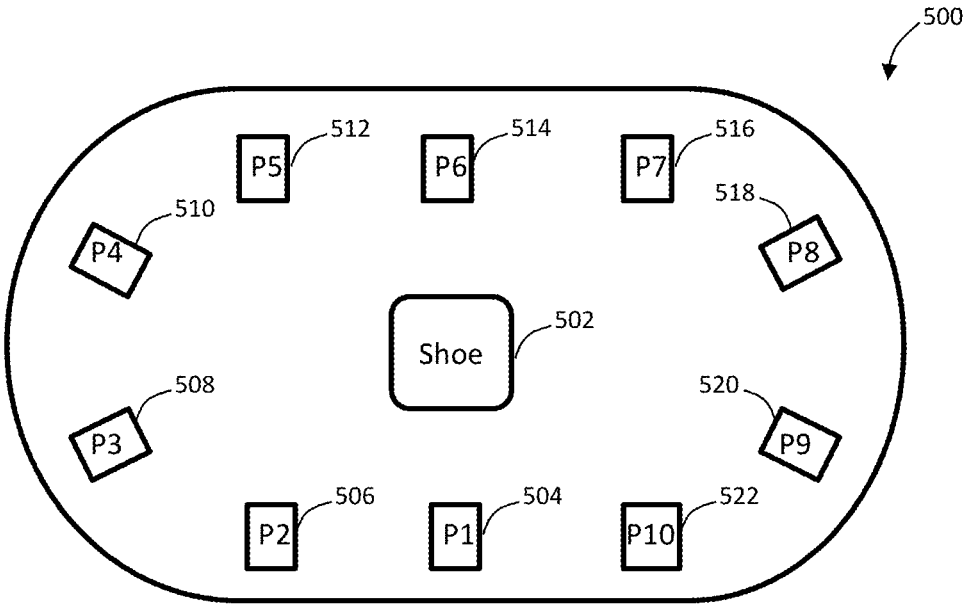
FIG. 5 shows an illustrative virtual poker game that does not include a dedicated dealer.

Referring to FIG. 5, there is shown an illustrative virtual poker game 500 that does not include a dedicated dealer. The parties in the illustrative virtual poker game 500 include a shoe module 502 and player computing devices 504 through 522. In the illustrative video poker game embodiment 500, the role of dealer is performed by one of players 504 through 522. The player responsible for the dealer module is selected according to agreed upon game rules. Thus, the player computing device that performs the operations corresponding to the dealer module may be selected randomly from the group of players 504 through 522. The operations performed by the dealer module may be transferred from one player to another player after a hand of poker has been played. Additionally, the operations performed by the dealer module may also reside with one player computing device. Since the operations performed by the dealer module may be performed by the players 504 through 522, there is no need for a game operator.

The shoe module 502 operates in a manner similar to shoe module 402, which may be controlled by a third party. The shoe module 502 performs a variety of functions that include shuffling the deck of cards and revealing the cards to the player computing devices, when the player asks for the cards.

Figure 6:
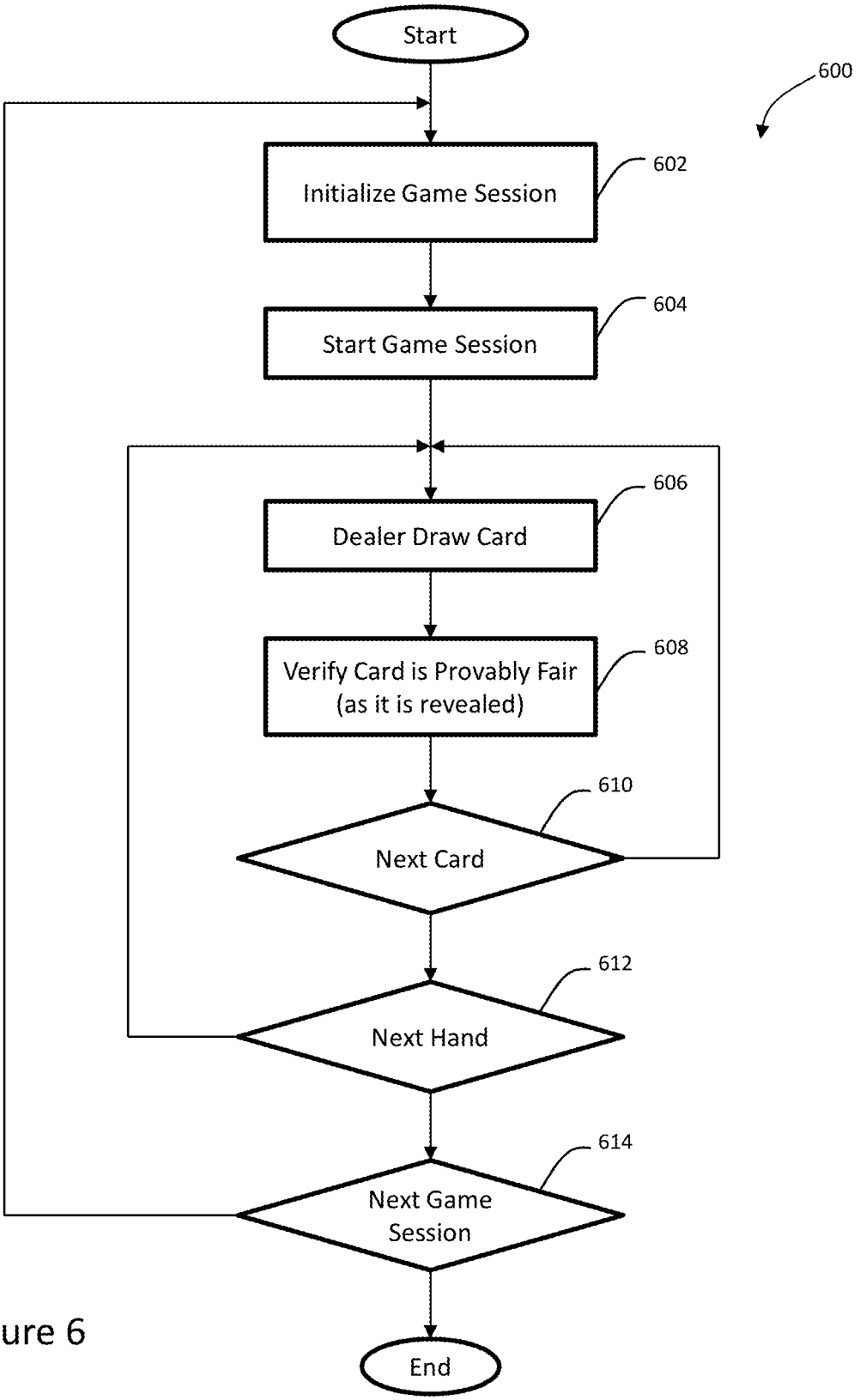
FIG. 6 shows an illustrative high level flowchart of the provably fair gaming process for multiple player games.

Referring to FIG. 6, there is shown a high level flowchart 600 of an illustrative provably fair gaming method for multiple player games. The method is initiated at block 602 where the game session is initialized. For the illustrative poker embodiment, the process of initializing the game session refers to the process of having a dealer module request a deck of cards from a shoe module, and the shoe module generating a shuffled deck.

The method then proceeds to block 604, where the game session starts. In the illustrative embodiment, the game session begins when a player places the appropriate wager or bet.

A game session includes more than one game event that corresponds to a "primary" game or "base" game. The illustrative primary game is a multiple player game such as poker, blackjack or other such card game. The primary game may also be embodied in a slot machine, a dice game, a bingo game and other such game of chance.

The primary game session yields a game event such as a random game outcome. Another illustrative game event includes the receipt of a wager or credits, which are received or transferred to the game such as game event 602. The primary game session may also be initiated by other game events including, but not limited to, a player hitting a spin button, a start button, a deal button, or any other such input indicating that the player is desirous of starting the primary game session. The primary game session may be terminated voluntarily when the player elects to stop the game, or involuntarily when the gaming device terminates the primary game session based on a termination event.

As used herein, the terms "bonus game," "secondary game," "bonus game session," refer generally to a game or a component of a game involving procedures in addition to the primary game. Typically, the bonus game session is initiated after the primary game session and only after a particular condition has been triggered or satisfied that causes the bonus game session to be initiated. The bonus game session may also include a plurality of bonus game events. Bonus games are common for slot machines. For example, when the illustrative primary game includes a slot game, the bonus game may allow players the possibility of winning more than the pay table indicates. Typically, the bonus game outcome depends upon the outcome of the primary game. For example, a bonus game outcome may depend upon a particular symbol being displayed on a slot reel when one of final game events take place. Also, the bonus game outcome may depend upon winning a payout from a slot game play while the gaming machine is in a "bonus zone." In other embodiments, the bonus game may be unconnected with the outcome of a primary game play.

In the illustrative embodiment, the primary game session is an online multiple player poker game. However, the illustrative online multiple player poker game is not limiting and other casino table games may also be supported by the systems and methods presented herein. By way of example and not of limitation, casino table games may also include blackjack (also known as "21"), Pai Gow, Baccarat, and other such card games. Additionally, other casino table games include, but are not limited to, wheel games such as roulette and dice games such as craps, Sic Bo and other such dice games.

At block 606, the method proceeds by having the dealer randomly draw a final hash from a committed deck for the illustrative multiple player poker game, which is somewhat similar to drawing a card from a deck of cards in that a transfer occurs from the deck to the player according to game rules.

The random selection of the card may be verified at block 608 using the offline verification method described herein.

At decision diamond 610, the game event of selecting the next random card is performed according to the game rules of the primary game, e.g. the particular illustrative poker game. For example, a poker player may elect to fold or hold their cards during a particular hand. The determination of whether the player wins or loses is made according to the poker game rules for that particular hand. If the players do not select another card, then the game play for the particular hand is completed.

After the hand is completed, the method proceeds to decision diamond 612, where the determination of whether to play the next hand is performed. If the decision is made to play another hand, then the method returns to block 606 and another card is drawn. Alternatively, the decision may be to start with a new deck and the method proceeds to decision diamond 614, where the player or players decide whether to continue with another game session or terminate the game session.

Figure 7:
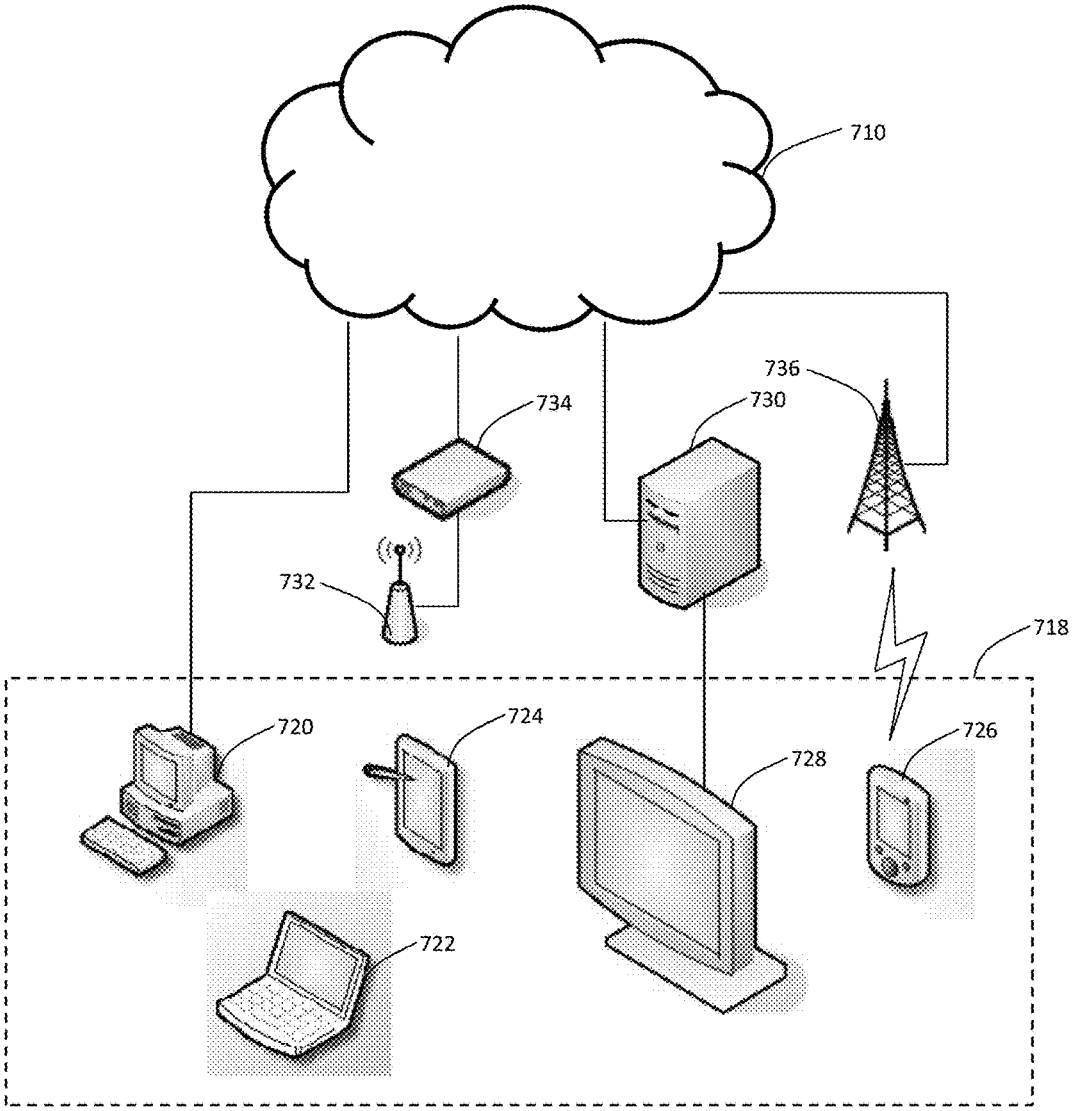
FIG. 7 shows an illustrative networked service offering that includes a server based service offering or a cloud based service offering.

Referring to FIG. 7, there is shown an illustrative networked service offering that includes a server based service offering or a cloud based service offering. The illustrative networked or cloud service 710 is configured to communicate with client devices 718. The illustrative client devices include a personal computer 720, a laptop 722, a tablet computer 724, a smartphone 726, and a display 728 that has a wired connection to a networked computer 730. The clients 718 may be operationally coupled to a wide area network (WAN) such as the Internet with a wireless connection. The wireless clients may be communicatively coupled to the WAN via a Wi-Fi (or Bluetooth) access point 732 that is communicatively coupled to an illustrative modem 734, which is communicatively coupled to the WAN. The wireless clients may also be communicatively coupled to the WAN using a proprietary carrier network that includes illustrative communication tower 736.

The illustrative cloud service may be embodied as one of four fundamental cloud service models, namely, infrastructure as a service (IaaS), platform as a service (PaaS), software as a service (SaaS), and network as a service (NaaS). The cloud service models are deployed using different types of cloud deployments that include a public cloud, a community cloud, a hybrid cloud, and a private cloud.

Figure 8:
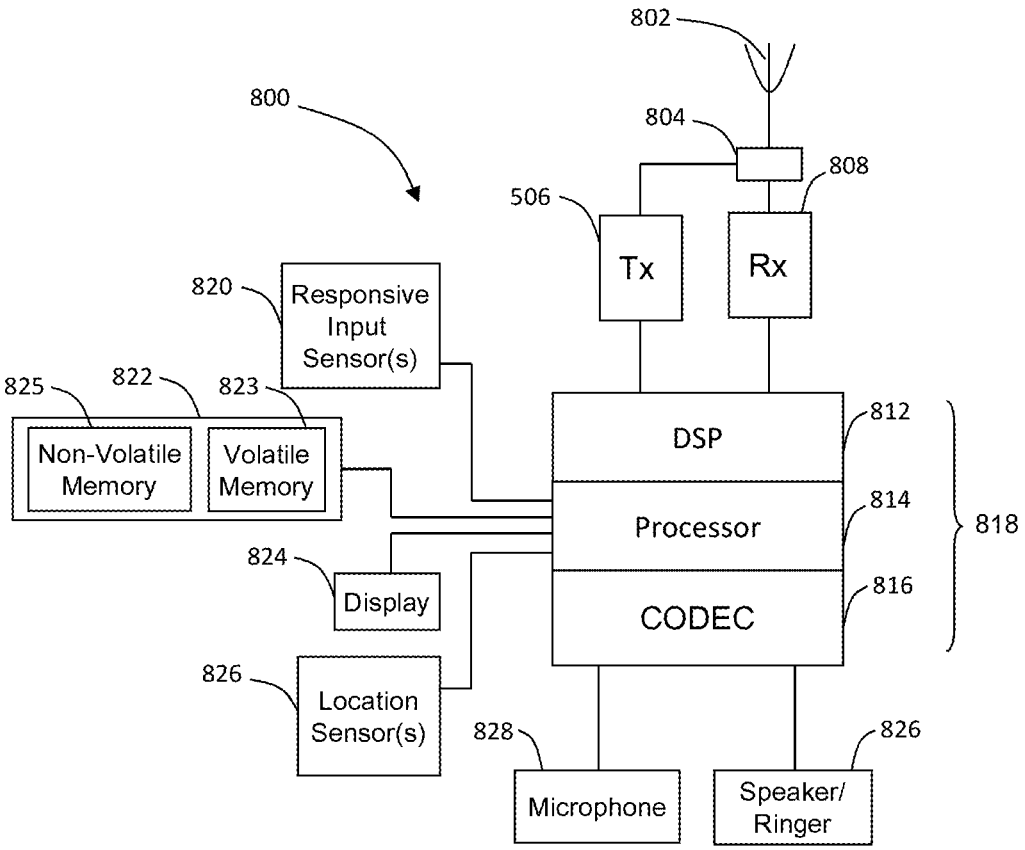
FIG. 8 shows an illustrative embodiment of the electrical components for a wireless device.

Referring to FIG. 8, there is shown the electrical components for an illustrative wireless device 800. For purposes of this patent, the illustrative wireless device 800 is a multimode wireless device that comprises a first antenna element 802 that is operatively coupled to a duplexer 804, which is operatively coupled to a multimode transmitter module 806, and a multimode receiver module 808.

An illustrative control module 818 comprises a digital signal processor (DSP) 812, a processor 814, and a CODEC 816 that are communicatively coupled to the transmitter 806 and receiver 808. It shall be appreciated by those of ordinary skill in the art that the transmitter module and receiver module are typically paired and may be embodied as a transceiver. The illustrative transmitter 806, receiver 808, or transceiver is communicatively coupled to antenna element 802.

The DSP 812 may be configured to perform a variety of operations such as controlling the antenna 802, the multimode transmitter module 806, and the multimode receiver module 808. The processor 814 is operatively coupled to a responsive input sensor 820 such as a keypad or a touch screen.

The processor 814 is also operatively coupled to a memory 822, a display 824, and a sensor 826. The sensor 826 may be used to determine an indoor and outside location for the illustrative wireless device.

Additionally, the processor 812 is also operatively coupled to the CODEC module 816 that performs the encoding and decoding operations and is communicatively coupled to a speaker 826, and a microphone 828. The CODEC module 816 is also communicatively coupled to the display 824 and provides the encoding and decoding operations for video.

The memory 822 includes two different types of memory, namely, volatile memory 823 and non-volatile memory 825. The volatile memory 823 is computer memory that requires power to maintain the stored information, such as random access memory (RAM). The non-volatile memory 825 can retain stored information even when the wireless communication device 800 is not powered up. Some illustrative examples of non-volatile memory 825 include flash memory, ROM memory, and hard drive memory.

Wireless device 800 may be a mobile handset, mobile phone, wireless phone, portable cell phone, cellular phone, portable phone, a personal digital assistant (PDA), a tablet, a portable media device, a wearable computer, or any type of mobile terminal which is regularly carried by an end user and has all the elements necessary for operation in a wireless communication system. The wireless communications include, by way of example and not of limitation, CDMA, WCDMA, GSM, UMTS, or any other wireless communication system such as wireless local area network (WLAN), Wi-Fi or WiMAX.

Figure 9:
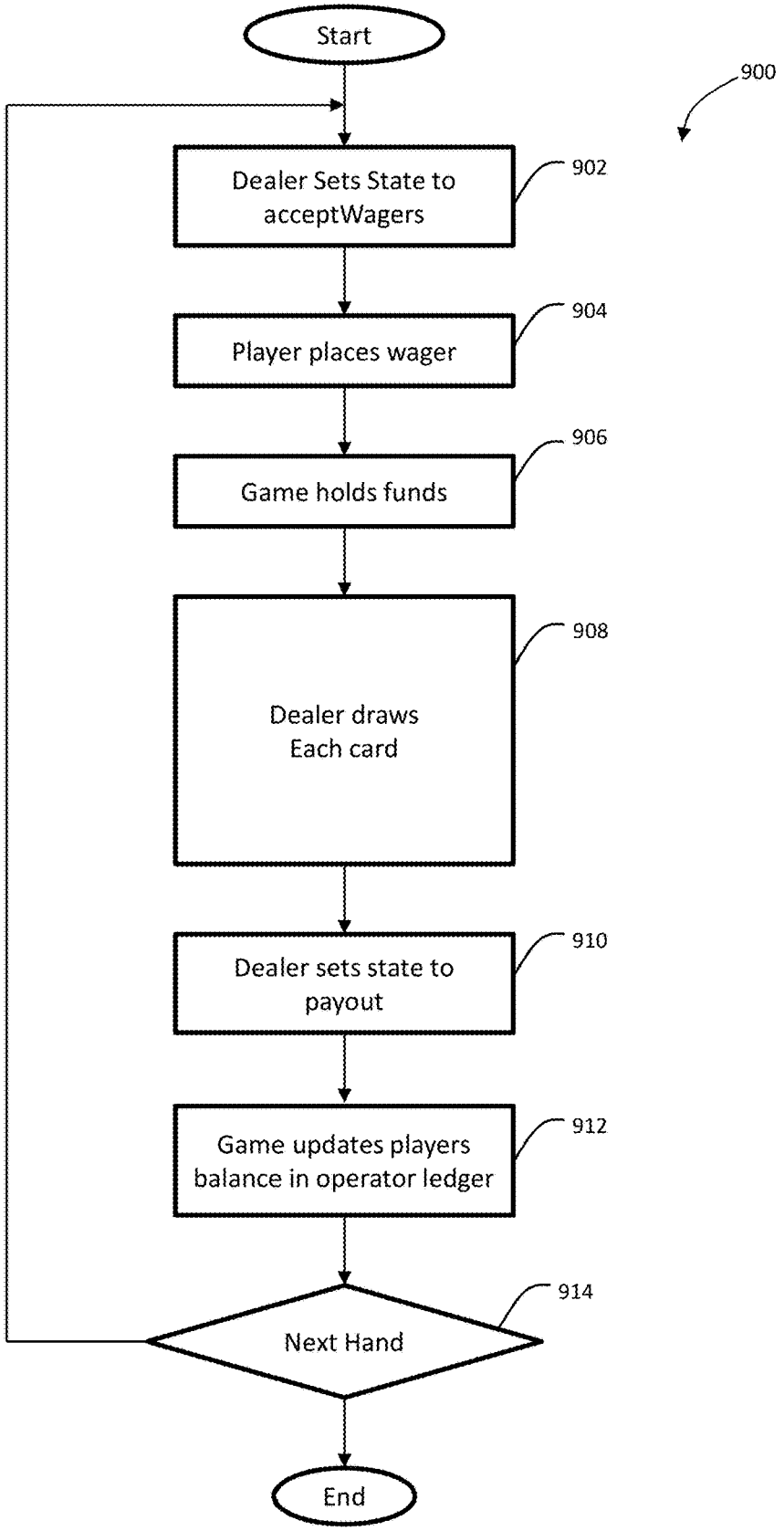
FIG. 9 shows an illustrative embodiment of the process of placing wagers and the game holding funds according to a payout.

Referring to FIG. 9, there is shown an illustrative embodiment of a process 600 of placing wagers and a game holding funds according to a payout. In various embodiments, the process 900 may begin at block 902, where a dealer (or a dealer function executed by a processor) may be set to a state in which it accepts one or more wagers from one or more players, as for example, at a betting stage of an online or virtual poker game. In this state, one or more players may, as shown at block 904, place a wager, whereupon the game (or a game function executed by a processor) may hold (e.g., store to a memory coupled to the processor) funds associated with each player wager, as shown at step 906.

As game play continues, the dealer may draw a virtual card (having a face value, e.g., Ace, King, Queen, etc.) from a virtual deck, as shown at step 908, and, having drawn one or more virtual cards (e.g., according to the rules of the multi-player game being implemented by the dealer), the dealer may set a state to payout, as shown at block 910. In response to a payout state, as shown at block 912, the game may update an account balance associated with one or more players, such as, for example, an account balance in an operator ledger stored in a memory coupled to the processor). More particularly, the game may add funds and/or remove funds from a player's account balance based upon the outcome of the game. Having updated the account balance of one or more game players, as shown at block 914, the game may proceed, as in a game of poker, to a next hand and/or, where there are no hands remaining, the game may end.

Figure 10A:
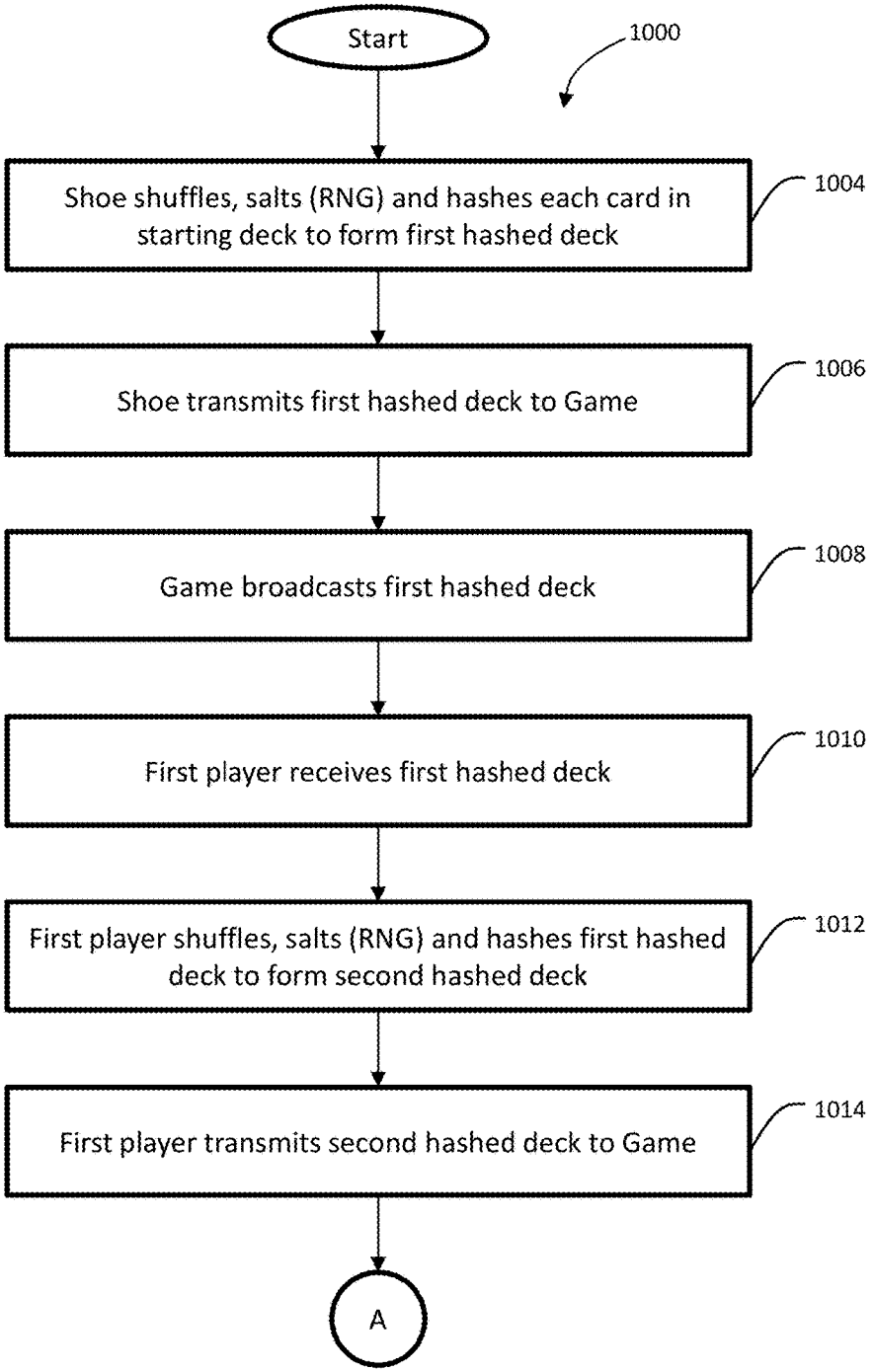
FIGS. 10A through 10C shows an illustrative embodiment of the process for forming a committed deck of virtual cards as part of a provably fair gaming process.

With reference to FIG. 10A, a process 1000 for forming a committed deck of virtual cards as part of a provably fair game is shown. FIG. 7 illustrates a process in which there are three players, a shoe, and a dealer. However, as described elsewhere herein, any number of players may participate in the process 1000, and in some embodiments, a player may perform the function of a dealer, such that there is no designated dealer.

In various embodiments, a processor may execute instructions such that the processor performs a shoe function and/or acts as a "shoe," e.g., a gaming device that holds or stores multiple decks of virtual cards. A processor may also, in various embodiments, execute software that performs a "game" or game function, such as for example, any processing function that executes or performs a multi-player game. In addition, in various embodiments, the processor may execute a dealer and/or player function, such that the processor acts as a virtual card dealer and/or one or more virtual players.

Accordingly, as shown at block 1004, the shoe may shuffle a virtual deck of cards. For instance, the shoe may shuffle each of a plurality of virtual cards. As used herein, a virtual card may comprise a face value (such as Ace, King, Queen, etc.) and may be represented by an identifier, such as an alphanumeric string or hash code. A virtual deck may comprise an array of virtual cards (e.g., an array of fifty-two virtual cards).

With continuing reference to block 1004, the shoe may further salt each card value with a random number or shoe salt value, such as a random alphanumeric string. A card value may be salted by appending the salt value to the card value. Moreover, in various embodiments, the shoe may apply a hashing function or algorithm to (or "hash") each salted card value to generate a hashed card value. Thus, a virtual deck may comprise a plurality of hashed card values.

More particularly, in various embodiments, a shoe may shuffle, salt, and hash each card in a starting deck of cards (e.g., an unhashed deck of starting card values) to form a first hashed deck. The first hashed deck may comprise, as described above, a plurality of hashed (and/or salted) card values. The shoe may apply a unique hashing function (such as a "shoe hashing function") to each starting card value in the starting deck to generate the first hashed deck.

As shown at block 1006, the shoe may transmit the first hashed deck to the game. The game may receive the first hashed deck and as shown at block 1008, in response to receiving the first hashed deck, broadcast the first hashed deck to one or more players, the dealer, and/or the shoe. At block 1010, a first player may receive the broadcast first hashed deck and, as shown at block 1012, the first player may, like the shoe at step 1004, shuffle, salt, and hash each card in the first hashed deck to form a second hashed deck. The salt appended to each hashed card value in the first hashed deck by the first player may be a first player salt that is unique to the first player and different from any other salt value used during game play. Similarly, the hash code used by the first player may be unique to the first player and different from any other hash code used during game play.

Having formed the second hashed deck, the first player may transmit the second hashed deck, as shown at block 1014, to the game. The game may broadcast the second hashed deck to one or more players, the dealer, and/or the shoe, as shown at block 1016. Further, as shown at block 1018, a second player may receive the second hashed deck as part of the broadcast, and, like the first player before at step 1012, the second player may, at step 1020, shuffle, salt, and hash each card in the second hashed deck to form a third hashed deck. The salt appended to each hashed card value in the second hashed deck by the second player may be a second player salt that is unique to the second player and different from any other salt value used during game play. Similarly, the hash code used by the second player may be unique to the second player and different from any other hash code used during game play.

The process described above (shuffling, salting, and hashing subsequently shuffled, salted, and hashed card values) may be repeated indefinitely and for/by each player in a multi-player game, the dealer, and/or the shoe. Thus, each player, the dealer, and/or the shoe may add a unique salt and uniquely hash each card value.

Figure 10B:
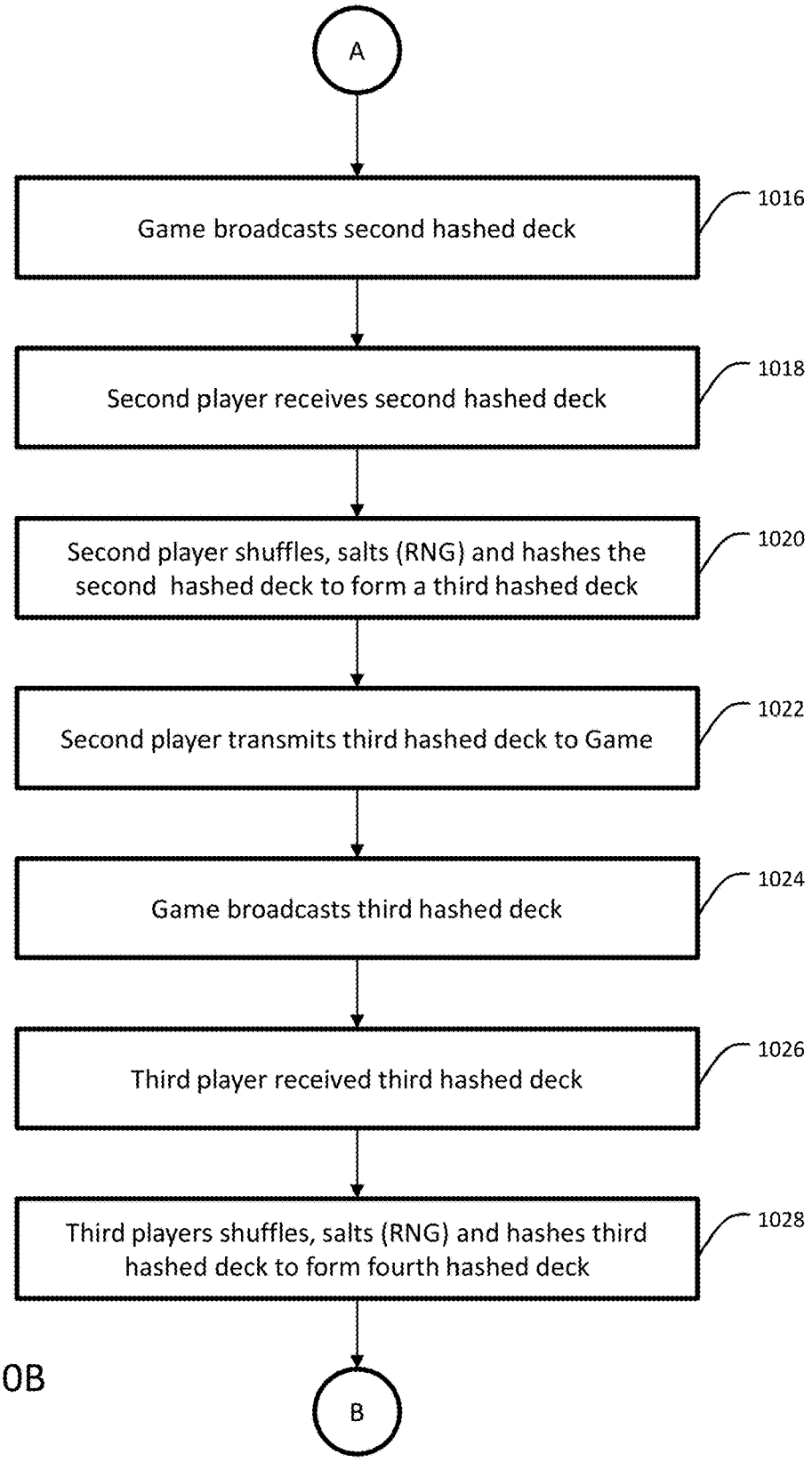

For example, and with continuing reference to FIG. 10B, at block 1022, the second player may, in various embodiments, transmit the third hashed deck to the game. The game may broadcast the third hashed deck to one or more players, the dealer, and/or the shoe, as shown at block 1024. Further, as shown at block 1026, a third player may receive the third hashed deck as part of the broadcast, and, like the second player before at step 1020, the second player may, at step 1028, shuffle, salt, and hash each card in the third hashed deck to form a fourth hashed deck. The salt appended to each hashed card value in the third hashed deck by the third player may be a third player salt that is unique to the third player and different from any other salt value used during game play. Similarly, the hash code used by the third player may be unique to the third player and different from any other hash code used during game play.

Figure 10C:
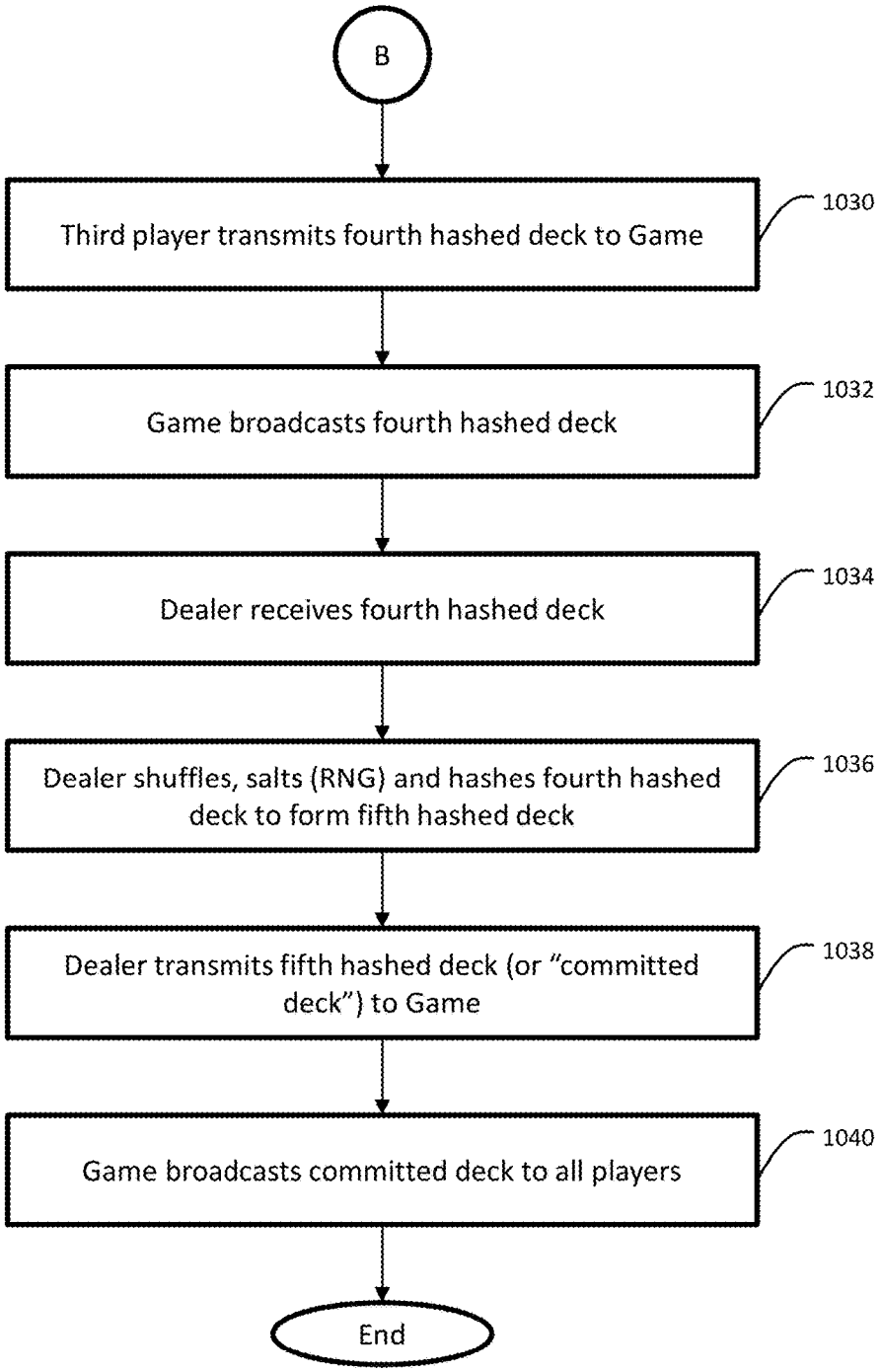

Continuing with the example described at FIG. 10C, at block 1030, the third player may, in various embodiments, transmit the fourth hashed deck to the game. The game may broadcast the fourth hashed deck to one or more players, the dealer, and/or the shoe, as shown at block 1032. Further, as shown at block 1034, a dealer may receive the fourth hashed deck as part of the broadcast, and, like the third player before at step 1028, the second player may, at step 1036, shuffle, salt, and hash each card in the fourth hashed deck to form a fifth hashed deck. The salt appended to each hashed card value in the fourth hashed deck by the dealer may be a dealer salt that is unique to the dealer and different from any other salt value used during game play. Similarly, the hash code used by the dealer may be unique to the dealer and different from any other hash code used during game play.

In the various embodiments, the final salted and hashed deck is referred to as the "committed deck." More generally, this committed deck may be salted and hashed, as described elsewhere herein, by the shoe and by each player in sequence until the shoe, each player, and the dealer have salted and hashed each of the card values; thus, a committed deck may comprise a plurality of multiply salted and multiply hashed card values.

Having formed a committed deck, the dealer may transmit the committed deck, as shown at block 1038, to the game, and the game may, in turn, broadcast the committed deck to each player, the dealer, and/or the shoe, as shown at step 740. Each player, the dealer, and/or the shoe may store the committed deck in memory, such as, for example, as part of a look up table.

As a result of the process 1000, each player (as well as the dealer and shoe) may have a copy of both the committed deck and the hashed deck formed by the player, dealer, or shoe. In addition, each player, dealer, and/or the shoe may, in addition to the committed deck, store a copy of the deck formed by the player, dealer, or shoe. Thus, each player, the dealer, and the shoe may store a copy of the committed deck (which includes the finally hashed deck of virtual cards) as well as a copy of the deck that was hashed by the player, dealer, or shoe. The shoe, therefore, is the only entity that stores a copy of the actual starting value or face value (e.g., Ace, King, Queen) of a particular virtual card. The other entities (players, and dealer) only store copies of the hashed deck (or "initial deck") that they were provided by the preceding entity, the copy of the re-hashed deck that the entity generated using its unique salt and hashing algorithm, and the committed deck.

The game may validate or "prove" that a virtual card being played during the game is genuine (i.e., untampered with or fair). Validation may be accomplished by way of a "rewind" process, as described below.

For instance, and by way of example, a game may validate a particular virtual card by successively hashing and salting a starting card value with a shoe salt, a shoe hash code, each player salt and player hash code, and the dealer (if there is a dealer, as described above) salt and dealer hash code and comparing the resulting successively salted and hashed virtual card value to the stored committed card value. If the values match, the virtual card is "proved" valid, and if not, it is proved invalid.

Such a comparison or "rewind" process is possible, because, as described above, the shoe, the dealer, and each player may pass its unique hashed card value, salt, and hashing function to the game. Thus, the game, having each "initial" card value (beginning with the starting value stored by the shoe and/or the initial hashed valued generated by the shoe) may successively hash the card value through each of the player and dealer salts and hashing functions to arrive at a committed value, which, if it matches the stored committed value, may be presumed or "proved" valid.

Figure 11:
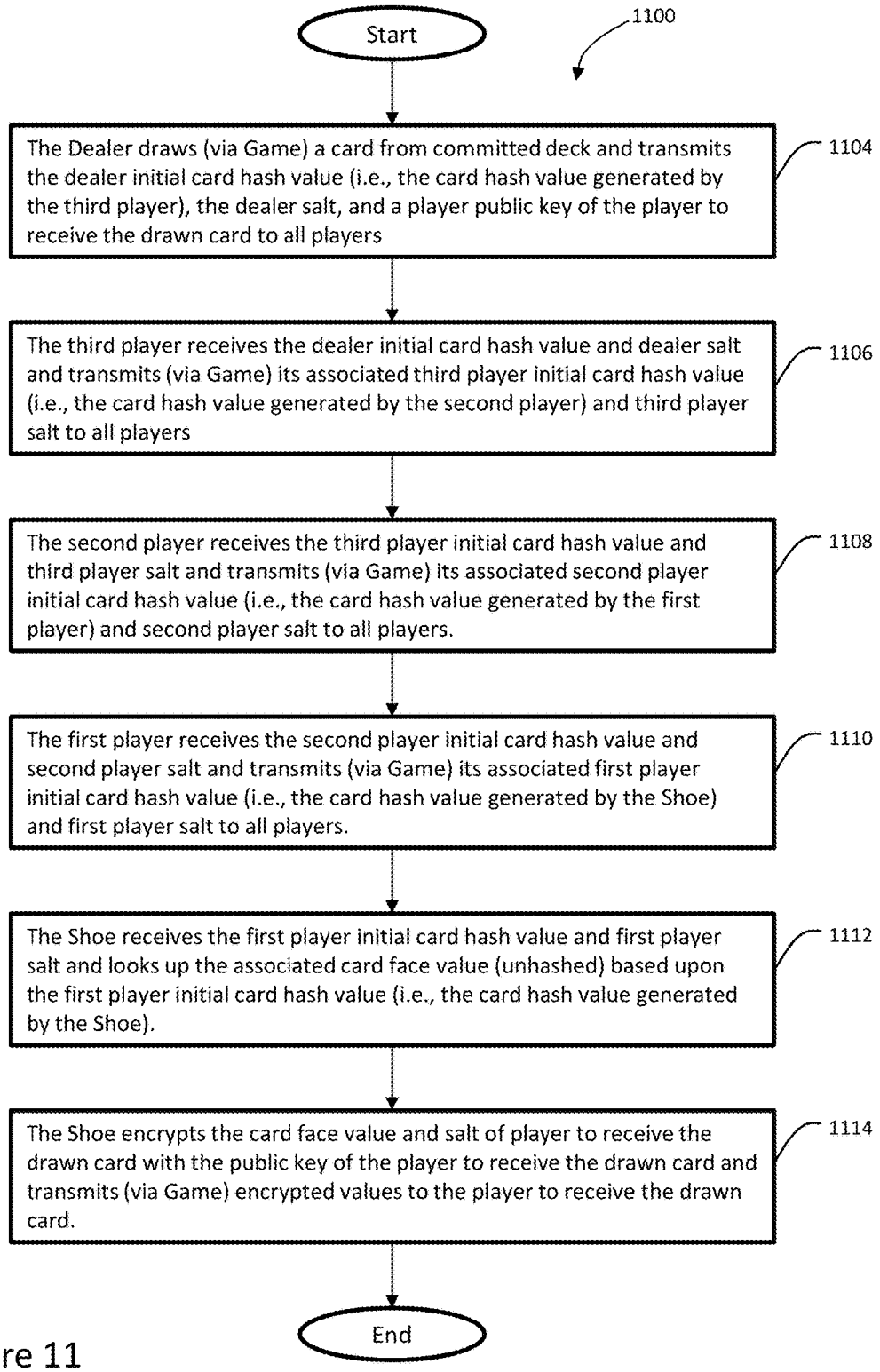
FIG. 11 shows an illustrative embodiment of the process for playing a provably fair multi-player game using a committed deck of virtual cards.

With reference now to FIG. 11, a process 1100 for playing a provably fair multi-player game using a committed deck of virtual cards is shown. More particularly, having formed a committed deck, a dealer may draw, via a game or game function of a processor, a virtual card from the committed deck, as shown at block 1104. The dealer may transmit, as further shown at block 1104, the initial card hash value (or dealer initial card hash value), the dealer salt, and a player public key to one or more players. The dealer initial card hash value is the hash value that the dealer salted with the dealer salt and hashed with the dealer hash function to arrive at the committed card value; it is also the card hash value generated by the third player in the example embodiment. The player public key transmitted by the dealer is the public key of the player to whom the drawn virtual card is to be dealt.

As shown at block 1106, the third player receives the dealer initial card hash value (which is, again, the hashed card valued generated by the third player) from the game or game function and, in response, looks up (e.g., by way of a look-up table) the initial card hash value (or the third player initial card hash value) that the third player salted and hashed to arrive at the hashed card value that the third player generated. The third player initial card hash value is also the card hash value generated by the second player, or the second player card hash value. The third player also retrieves, from the look-up table, the third player salt that the third player used to generate the third player hashed card value. Having recovered the third player initial card hash value and third player salt, the third player transmits the third player initial card hash value and the third player salt to one or more players, the dealer, and/or the shoe.

As shown at block 1108, the second player receives the third player initial card hash value (which is, again, the hashed card valued generated by the second player) from the game or game function and, in response, looks up (e.g., by way of a look-up table) the initial card hash value (or the second player initial card hash value) that the second player salted and hashed to arrive at the hashed card value that the second player generated. The second player initial card hash value is also the card hash value generated by the first player, or the first player card hash value. The second player also retrieves, from the look-up table, the second player salt that the second player used to generate the second player hashed card value. Having recovered the second player initial card hash value and second player salt, the second player transmits the second player initial card hash value and the second player salt to one or more players, the dealer, and/or the shoe.

Continuing, as shown at block 1110, the first player receives the second player initial card hash value (which is, again, the hashed card valued generated by the first player) from the game or game function and, in response, looks up (e.g., by way of a look-up table) the initial card hash value (or the first player initial card hash value) that the first player salted and hashed to arrive at the hashed card value that the first player generated. The first player initial card hash value is also the card hash value generated by the shoe, or the shoe card hash value. The first player also retrieves, from the look up table, the first player salt that the first player used to generate the first player hashed card value. Having recovered the first player initial card hash value and first player salt, the first player transmits the first player initial card hash value and the first player salt to one or more players, the dealer, and/or the shoe.

Now, at block 1112, the shoe receives the first player initial card hash value and the first player salt from the game or game function and, in response, looks up (e.g., by way of a look-up table) the card start value (i.e., the face value of the card) based upon the first player initial card hash value. Having located, through the series of reverse-lookups described herein and above, the shoe, at block 1114, encrypts the card start value and the salt of the player who is designated to receive the drawn card. The encryption is performed as part of a public key infrastructure ("PKI") encryption method, in which the drawn card value is encrypted with the public key of the player who is designated to receive the card and, therefore, only capable of decryption by the designated player using the designated player's private key.

The shoe therefore transmits the encrypted drawn card value to the designated player who decrypts the card value to participate in the game. In various embodiments, if the multi-player game is poker, and if the player decides to "fold" the card, the game may not reveal the card face value to the remaining players and/or the dealer in the game. However, where the player decides to "play" the card, the game may reveal, at some point during the multi-player game, the card face value to other players and/or the dealer.

The process 1100 described above may be repeated indefinitely and for each player in a multi-player game, the dealer, and/or the shoe. Thus, the process 1100 may apply to a multi-player game of any size and including any number of players.

Thus, the systems and methods disclosed herein permit provably fair gaming solutions. For example, as described herein, a provably fair game may generate a committed deck by successively shuffling, salting, and hashing each of a plurality of card values using a plurality of shoe, player, and dealer salt values and hash functions. The resulting committed card values may be verified or proven fair by "rewinding" the salting and hashing process and comparing the "rewound" or re-computed final card hash value with a committed card hash value. In addition, a provably fair game may be played by a plurality of players such that a card drawn from a committed deck is rewound to its starting or face card value, encrypted with a player public key, and transmitted to a player designated to receive the card.

It is to be understood that the detailed description of illustrative embodiments are provided for illustrative purposes. Thus, the degree of software modularity for the systems and methods presented above may evolve to benefit from the improved performance and lower cost of the future hardware components that meet the system and method requirements presented. The scope of the claims is not limited to these specific embodiments or examples. Therefore, various process limitations, elements, details, and uses can differ from those just described, or be expanded on or implemented using technologies not yet commercially viable, and yet still be within the inventive concepts of the present disclosure. The scope of the invention is determined by the following claims and their legal equivalents.

What is claimed is:

1. A provably fair gaming system comprising:

a game session associated with a gaming module disposed on a server module, wherein the game session includes a plurality of game events and a plurality of game objects, wherein each game object has a value and a position relative to the other game objects, and wherein the plurality of game objects are organized according to instructions associated with the gaming module;

a first player client computing device and a last player client computing device that each participate in the game session;

a server module that generates a plurality of salts, the server module further generates a plurality of salted game objects, wherein each salted game object corresponds to a concatenation of one game object and one salt, the server module further hashes each salted game object to generate a plurality of starting hash values, the server module further communicates the plurality of starting hash values to the first player client computing device;

the first player client computing device generates a plurality of first player salts, the first player client computing device further generates a plurality of first player salted game objects, wherein each first player salted game object corresponds to a concatenation of one starting hash value and one first player salt, the first player client computing device further hashes each first player salted game object to generate a plurality of first player hash values, wherein each first player hash value is salted and hashed by each player until a last player client computing device generates a plurality of last player hash values; and the server module further generates a plurality of final salts, the server module further generates a plurality of finally salted game objects, wherein each finally salted game object corresponds to a concatenation of one last player hash value and one final salt, the server module further hashes each finally salted game object to generate a plurality of final hash values, and the server module further communicates certain final hash values to the player client computing devices according to the gaming module instructions.

2. The provably fair gaming system of claim 1 wherein the plurality of first player hash values and the plurality of last player hash values are the same, when the first player client computing device is the only player client computing device participating in the game session.

3. The provably fair gaming system of claim 1 further comprising, the last player client computing device receives a plurality of penultimate player hash values, the last player client computing device generates a plurality of last player salts, the last player client computing device combining each penultimate player hash value and one last player salt to generate a plurality of last player salted game objects, and the last player client computing device generating a plurality of last player hash values by hashing each of the last player salted game objects.

4. The provably fair gaming system of claim 1 further comprising, a second player client computing device that receives the plurality of first player hash values, the second player client device generates a plurality of second player salts, the second player client device generates a plurality of second player salted game objects by concatenating each first player hash value and one second player salt, and the second player client device generating a plurality of second player hash values by hashing each second player salted game object.

5. The provably fair gaming system of claim 1 wherein the plurality of game objects include a plurality of playing cards and the gaming module is a poker gaming module, the gaming system comprising, a dealer module associated with a first server module, wherein the dealer module corresponds to a poker dealer that initiates a poker game session;

the plurality of player client computing devices configured to join the poker game session;

each of the player client computing devices configured to exchange public keys;

the dealer module configured to request a deck of playing cards from a shoe module, wherein the shoe module is associated with a second server module; and the shoe module configured to salt each playing card and the shoe module generates a starting hash value for each playing card and communicates the starting hash values to the player client computing devices according to the instructions associated with the gaming module.

6. The provably fair gaming system of claim 1 wherein each player client computing device receives a position for at least one game object;

each player client computing device receives a list of salts used to generate the final hashes;

each player client computing device receives the final hashes associated with the game objects;

each player client computing device configured to be placed in an off-line mode;

each player client computing device, operating in an off-line mode, configured to salt and hash a selected game object to generate an off-line final hash; and each player client computing device, operating in an off-line mode, configured to compare the off-line final hash with the received final hash to determine that the position of the game object was presented according to the game rules.

7. A provably fair gaming method comprising:

initiating a game session with a gaming module disposed on a server module, wherein the game session includes a plurality of game events and a plurality of game objects, wherein each game object has a value and a position relative to the other game objects;

identifying, by the server module, a list of player client computing devices that participate in the game session including a first player client computing device and a last player client computing device;

generating, by the server module, a plurality of salts;

salting, by the server module, each game object to generate a plurality of salted game objects, wherein each salted game object corresponds to a concatenation of one game object and one salt;

hashing each salted game object at the server module to generate a plurality of starting hash values;

communicating each starting hash value to the first player client computing device;

generating a plurality of first player salts, by the first player client computing device;

generating, by the first player client computing device, a plurality of first player salted game objects, wherein each first player salted game object corresponds to a concatenation of one starting hash value and one first player salt;

generating, by the first player client computing device, a plurality of first player hash values, wherein each first player hash value corresponds to a hash of one first player salted game object, wherein each first player hash value is salted and hashed by each player client computing device until a last player client computing device generates a plurality of last player hash values;

receiving, by the server module, the plurality of last player hash values;

generating, by the server module, a plurality of final salts;

generating, by the server module, a plurality of final hash values, wherein each final hash value corresponds to a hash of a concatenation of one last player hash value received by the server module and one final salt; and communicating, by the server module, certain of the plurality of final hash values to the player client computing devices according to instructions associated with the gaming module.

8. The provably fair gaming method of claim 7 wherein the plurality of first player hash values and the plurality of last player hash values are the same, when the first player client computing device is the only player client computing device participating in the game session.

9. The provably fair gaming method of claim 7 wherein the list of player client computing devices that participate in the game session further includes a second player client computing device, the gaming method further comprising, receiving, by the second player client computing device, the plurality of first player hash values, generating, by the second player client computing device, a plurality of second player salts, generating, by the second player client computing device, a plurality of second player salted game objects, wherein each second player salted game object corresponds to a concatenation of one first player hash value and one second player salt, and hashing, by the second player client computing device, each of the second player salted game objects to generate a plurality of second player hash values.

10. The provably fair gaming method of claim 7 wherein the plurality of game objects include a plurality of playing cards and the gaming module is a poker gaming module, the gaming method comprising, providing a dealer module associated with a first server module, wherein the dealer module corresponds to a poker dealer that initiates a poker game session, enabling the plurality of player client computing devices to join the poker game session, enabling each of the player client computing devices to exchange public keys, enabling the dealer module to request a deck of playing cards from a shoe module, wherein the shoe module is associated with a second server module, and salting each playing card with the shoe module, wherein the shoe module generates a starting hash value for each playing card and communicates the starting hash values to the player client computing devices according to the instructions associated with the gaming module.

11. The provably fair gaming method of claim 7 wherein each player client computing device receives the position for at least one game object, the method further comprising, enabling each player client computing device to receive a list of salts used to generate the final hashes;

enabling each player client computing device configured to be placed in an off-line mode;

enabling each player client computing device, operating in an off-line mode, configured to salt and hash a selected game object to generate an off-line final hash; and operating at least one player client computing device in an off-line mode that is configured to compare the off-line final hash with the received final hash to determine that the position of the game object was presented according to the game rules.

12. A provably fair gaming system comprising:

a game session associated with a gaming module, wherein the game session includes a plurality of game events and a plurality of game objects, wherein each game object has a value and a position relative to the other game objects, and wherein the plurality of game objects are organized according to instructions associated with the gaming module;

a plurality of player computing devices that include a host player computing device and a last player computing device, wherein each player computing device participates in the game session;

the host player computing device generates a plurality of host salts, the host player computing device further generates a plurality of salted game objects, wherein each salted game object corresponds to a concatenation of one game object and one host salt, the host player computing device further hashes each salted game object to generate a plurality of starting hash values wherein the plurality of starting hash values are salted and hashed by each player computing device until the last player computing device generates a plurality of last player resulting hash values;

and the host player computing device further generates a plurality of final salts, the host player computing device further generates a plurality of finally salted game objects, wherein each finally salted game object corresponds to a concatenation of one last player hash and one final salt, the host player computing device further hashes each finally salted game object to generate a plurality of final hash values, wherein the host player computing device communicates certain final hash values to the plurality of player computing devices according to the gaming module instructions.

13. The provably fair gaming system of claim 12 wherein the plurality of starting hash values and the plurality of last player hash values are the same, when the host player computing device is the only player computing device participating in the game session.

14. The provably fair gaming system of claim 12 wherein, the last player computing device receives a plurality of penultimate player hash values, the last player computing device generates a plurality of last player salts, the last player computing device combining each penultimate player hash value and one last player salt to generate a plurality of last player salted game objects, and the last player computing device generating a plurality of last player hash values by hashing each of the last player salted game objects.

15. The provably fair gaming system of claim 12 wherein the plurality of player computing devices includes a second player computing device that receives the plurality of starting hash values, the second player computing device generates a plurality of second player salts, the second player device generates a plurality of second player salted game objects by concatenating each starting hash value and one second player salt, and the second player device generating a plurality of second hash values by hashing each second player salted game object.

16. The provably fair gaming system of claim 12 wherein the plurality of game objects include a plurality of playing cards and the gaming module is a poker gaming module, the gaming system comprising:

a shoe module configured to salt each playing card and the shoe module generates a starting hash value for each playing card and communicates the starting hash values to the player computing devices according to the instructions associated with the gaming module.

17. The provably fair gaming system of claim 12 wherein each player computing device receives a position for at least one game object;

each player computing device receives a list of salts used to generate the final hashes;

each player computing device receives the final hashes associated with the game objects;

each player computing device configured to be placed in an off-line mode;

each player computing device, operating in an off-line mode, configured to salt and hash a selected game object to generate an off-line final hash; and each player computing device, operating in an off-line mode, configured to compare the off-line final hash with the received final hash to determine that the position of the game object was presented according to the game rules.

18. A provably fair gaming method comprising:

initiating a game session with a gaming module, wherein the game session includes a plurality of game events and a plurality of game objects, wherein each game object has a value and a position relative to the other game objects;

identifying, by the gaming module, a plurality of player computing devices that include a host player computing device and a last player computing device, wherein each player computing device participates in the game session;

generating, by the host player computing device, a plurality of host salts;

salting each of the game objects by the host player computing device to generate a plurality of salted game objects, wherein each salted game object corresponds to a concatenation of one game object and one host salt;

hashing each of the salted game objects by the host player computing device to generate a plurality of starting hash values, wherein each starting hash value is salted and hashed by each player computing device until the last player computing device generates a plurality of last player hash values;

receiving, by the host player computing device, the plurality of last player hash values;

generating, by the host player computing device, a plurality of final salts;

generating, by the host player computing device, a plurality of finally salted game objects, wherein each finally salted game object corresponds to a concatenation of one last player hash value and one final salt; and communicating, by the host player computing device, certain of the final hash values to the plurality of player computing devices according to instructions associated with the gaming module.

19. The provably fair gaming method of claim 18 wherein the plurality of starting hash values and the plurality of last player hash values are the same, when the host player computing device is the only player computing device participating in the game session.

20. The provably fair gaming method of claim 18 wherein the plurality of game objects include a plurality of playing cards and the gaming module is a poker gaming module, the gaming method comprising, enabling a plurality of player computing devices to join a poker game session, enabling each of the player computing devices to exchange public keys, enabling the host computing device to request a deck of playing cards from a shoe module, and salting each playing card and with the shoe module, wherein the shoe module generates a starting hash value for each playing card and communicates the starting hash values to the player computing devices according to the instructions associated with the gaming module.

21. The provably fair gaming method of claim 18 wherein the plurality of game objects include a plurality of playing cards and the gaming module is a poker gaming module, the gaming method comprising, enabling a shoe module to salt each playing card;

enabling the shoe module to generate a starting hash value for each playing card; and communicating, by the shoe module, the plurality of starting hash values to the player computing devices according to the instructions associated with the gaming module.

22. The provably fair gaming method of claim 18 wherein each player computing device receives the position for at least one game object, the method further comprising, enabling each player computing device to receive a list of salts used to generate the final hashes;

enabling each player computing device to receive the final hashes;

enabling each player computing device to be placed in an off-line mode;

enabling each player computing device to operate in an off-line mode;

enabling each player computing device to salt and hash a selected game object to generate an off-line final hash; and operating at least one player computing device in an off-line mode that is configured to compare the off-line final hash with the received final hash to determine that the position of the game object was presented according to the game rules.

* * * * *